US006648579B2

(12) United States Patent
Vartanian, Sr.

(10) Patent No.: US 6,648,579 B2
(45) Date of Patent: Nov. 18, 2003

(54) PLATFORM LIFT

(76) Inventor: Roger Vartanian, Sr., P.O. Box 636, Bonita Springs, FL (US) 18322

( * ) Notice: Subject to any disclaimer, the term of this patent is extended or adjusted under 35 U.S.C. 154(b) by 91 days.

(21) Appl. No.: 09/939,822

(22) Filed: Aug. 27, 2001

(65) Prior Publication Data

US 2002/0076313 A1 Jun. 20, 2002

Related U.S. Application Data

(63) Continuation-in-part of application No. 09/375,714, filed on Aug. 17, 1999, now Pat. No. 6,309,170.

(51) Int. Cl.[7] ..... A61G 3/06
(52) U.S. Cl. ..... 414/546; 414/921; 414/550
(58) Field of Search ..... 414/546, 550, 414/921

(56) References Cited

U.S. PATENT DOCUMENTS

| | | | | |
|---|---|---|---|---|
| 4,140,230 A | | 2/1979 | Pearson | 214/77 |
| RE31,178 E | | 3/1983 | Deacon | 414/546 |
| 4,456,421 A | | 6/1984 | Robson | 414/546 |
| 4,534,450 A | | 8/1985 | Savaria | 187/9 |
| 4,664,584 A | | 5/1987 | Braun et al. | 414/541 |
| 4,787,809 A | * | 11/1988 | Zrostlik | 414/557 |
| 4,804,308 A | | 2/1989 | Hamblin et al. | 414/540 |
| 4,808,056 A | | 2/1989 | Oshima | 414/462 |
| 4,966,516 A | | 10/1990 | Vartanian | 414/537 |
| 4,984,955 A | | 1/1991 | McCullough | 414/546 |
| 5,234,311 A | | 8/1993 | Loduha, Jr. et al. | 414/546 |
| 5,261,779 A | | 11/1993 | Goodrich | 414/546 |
| 5,542,811 A | | 8/1996 | Vartanian | 414/541 |
| 5,806,632 A | | 9/1998 | Budd et al. | 187/200 |
| 6,077,025 A | * | 6/2000 | Budd et al. | 414/546 |

OTHER PUBLICATIONS

Brochure—The Braun Corp., "L200UARS Series Ultra IV Wheelchair Lifts" 7/98, 1 page.
Web Page—Ricon Corp., "UNI–Lite," 2 pages, '00.

* cited by examiner

*Primary Examiner*—Steven A. Bratlie
(74) *Attorney, Agent, or Firm*—Duane Morris LLP

(57) ABSTRACT

A wheelchair lift for a vehicle has a parallelogram support for a platform foldable on a horizontal axis and hinged on a vertical axis. A hydraulic cylinder extends between end points that are spaced from the apices of members coupled as a parallelogram, the end points being on a line that is inclined outwardly (when the lift is retracted) and/or downwardly (when the lift is lowered). Barriers are coupled mechanically to the parallelogram members so as to deploy when the lift is first displaced from its stowed/retracted position. The barriers have a lost motion aspect whereby if a user is located in the deployment path and obstructs the deployment of the barrier(s), for example, the barrier moves up to the obstruction and stops against it while the lift can continue to move.

11 Claims, 14 Drawing Sheets

PLATFORM LIFT

CROSS-REFERENCE TO RELATED APPLICATION

This is a continuation in part o application Ser. No. 09/375,714, filed Aug. 17, 1999, now U.S. Pat. No. 6,309, 170.

BACKGROUND OF THE INVENTION

The invention concerns a platform lift, especially for transferring wheelchair occupants between a passenger compartment and the ground. The inventive lift has a particular configuration for parallelogram-linked support arms driven using a drive cylinder, and includes safety gates that are mechanically linked to operation of the lift.

In a preferred arrangement the lift mechanism has movable parts successively connected on different axes to permit rotation about the respective axes for stowing, deploying and moving a platform that supports the load, such as a wheelchair. The lift is apt for use in a van, bus or light truck.

The platform for the wheelchair or other load is pivotable on a horizontal axis between a horizontal supporting orientation and a vertical stowing orientation. In a preferred arrangement, the horizontal axis on which the platform pivots is in turn mounted so as to pivot on a vertical axis at one lateral side of the door, whereby the platform when oriented in a vertical position can be opened and closed like a door or gate panel.

The horizontal axis hinging is between the platform and a base plate. At one side of the doorway the baseplate is carried on a heavy duty vertical hinge axis coupling or journal post, and at the opposite side a protruding end of the baseplate is fixed with a clamping latch.

The horizontal axis pivoting between supporting and stowed positions and the vertical axis gate-like pivoting are between the platform part and two vertical standards that extend vertically and are disposed at the lateral opposite sides of the doorway. The vertical standards are mounted by a parallelogram linkage to vertical posts that are rigidly fixed to the vehicle at the lateral sides of the doorway.

The lift has at least three distinct modes of movement. In one mode, the parallelogram linkage holds the platform in a horizontal orientation as the platform is raised or lowered between ground level and the level of the vehicle passenger compartment. Movable gates at the platform edges permit the wheelchair to roll onto and off of the platform at either level and block roll-off when the wheelchair is between levels.

In a second mode, the platform is pivotable on a horizontal axis relative to the vertical standards. The platform is pivoted on the horizontal axis to raise the platform from its horizontal wheelchair-carrying orientation to a vertical stowed orientation.

A third mode is gate-like hinging to block or clear the doorway. With the platform vertical, and preferably with the vertical standards retracted via the parallelogram linkage, the platform and its base plate can be detached from one vertical standard to hinge on the vertical axis defined by the journal post at the other vertical standard, so as to hinge open and closed like a door or gate.

According to an inventive aspect, movable doorway plane barriers are linked between the relatively movable parts of the lift and are structured for automatic deployment when the platform is in a position other than coplanar with the passenger compartment. The barriers are linked with a sort of lost motion engagement rather than a positive engagement so that the barriers are compliant should they deploy onto an obstruction such as a person occupying the space. The barrier member is mechanically coupled to the movable parts of the lift by a mechanism having a lost motion component. The barrier member is deployed into position obstructing the doorway immediately upon displacement of the lift from a fully retracted position, wherein the barrier member is against a stop. On further displacement of the lift, the lost motion allows the barrier member to remain stationary as the lift is lowered. Moreover, the lost motion can be compliant if the barrier member is arrested short of its stop, for example if the barrier member is deployed against a person or an object in the doorway.

The movable vertical standards are connected to the fixed posts by a set of parallelogram arms. A drive means is provided such as a drive cylinder that is controllably extensible and retractable, e.g., a hydraulic or pneumatic cylinder, linear actuator motor or the like, for expanding or contracting the parallelogram linkage. According to an inventive aspect, the drive cylinder is mounted so as to have one or both of its opposite ends attached at rotational pivot points spaced from the pivot points that attach the parallelogram members. This arrangement has a number of advantages including the ability to orient the cylinder for urging in the vertical standards to nest of couple into the fixed posts, and a wear resistance aspect.

When nested together, the movable vertical standards engage with the fixed posts at engagement couplings, locking to provide a stable structure from which the platform can hinge on the journal post, without sagging.

A particularly robust and secure clamped latch arrangement is provided between the platform and the adjacent movable vertical standard on the side opposite from the vertical hinge. The clamped latch comprises a leveraged operator that fixes a protruding bar adjacent to the horizontal pivot axis of the platform, received in a structurally supportive receptacle coupled to the vertical movable frame. The journal post and clamping latch bear the concentrated load of a wheel chair on the platform when cantilevered outwardly.

PRIOR ART

Platform lifts with parallelogram linkage supports are disclosed, for example, in U.S. Pat. No. 4,456,421—Robson; U.S. Pat. No. 4,534,450—Savaria; U.S. Pat. No. 4,984,955—McCullough; U.S. Pat. No. 4,808,056—Oshima; U.S. Pat. No. 5,234,311—Loduha, Jr. et al.; U.S. Pat. No. 5,261,779—Goodrich; and, U.S. Pat. No. 5,806, 632—Budd et al., which are hereby incorporated. These patents disclose a number of alternative arrangements in which a load platform is carried by a movable member of a linkage structure having paired opposite members. Typically the opposite members are straight bars coupled to hinge or pivot at points near their ends.

A proximal one of the members is defined by or is rigidly attached to a portion of a vehicle at a doorway. The parallelogram linkage expands and contracts to move a load platform carried by a distal one of the members, back and forth between the ground level and the vehicle passenger compartment level. The members of the linkage need not be straight or elongated members. The pivots need not be located at the ends of the members. However, the members maintain a rigid space between hinge points that define the apices of a parallelogram. The parallelogram can expand into a rectangle where the lines connecting the pivot points are oriented at right angles at each of the four pivot points. The rectangle also can contract or collapse such that each pair of opposite angles becomes acute, with the other pair being obtuse. Assuming that there are no other impediments, the rectangle can collapse in either direction from a right angle. That is, either of the opposite pairs can become acute or obtuse.

A parallelogram linkage is advantageous in a load platform lift, for example for a wheelchair, because the linkage ensures that the opposite members of the linkage remain parallel. Thus if a proximal linkage member is vertical, for example being fixed at a vertical orientation in a vehicle doorway, the opposite member will also be vertical, at all positions of the parallelogram linkage. A load carrying platform can be arranged to be held horizontal on a linkage member that is opposite from the stationary linkage member of the parallelogram, and will remain horizontal as the lift moves.

Expansion and contraction of the parallelogram causes the lift platform to be raised and lowered. Typically, expansion from an upwardly collapsed position moves the platform outward and down. The linkage passes through an intermediate position at which the linkages are at right angles. Further downward movement of the platform carries the linkage into a downward and inward.

Driving forces can be coupled to the members of the parallelogram linkage in various ways. The parallelogram link members are structurally constrained by their connection to move only by expansion and collapse of the parallelogram. Any forces exerted in the required directions on the linkage members, or between the linkage members, may tend to expand or contract the members and thereby lift or lower the platform. However there are implications to driving the lift in one way or another.

It is possible to raise the lift, for example, by exerting a vertical force on any of the movable members at any point spaced from the stationary member. A chain or pulley arrangement with a flexible chain or belt can be connected between a parallelogram member and some higher point on the vehicle. Such a drive chain or pulley might not be the best choice for reasons of compactness, safety, mechanical advantage, cleanliness and other considerations. A drive cylinder is a neater and more compact alternative. However a drive cylinder or other driving device needs to develop the necessary force and to be connected to the linkage so as to provide the necessary leverage or mechanical advantage over the necessary length of stroke to move the lift between the passenger compartment and the ground. The traverse also needs to be accomplished in a reasonable time.

It may be preferable to have a moderate stroke rather than a very long or very short stroke, for reasons of expense. The drive cylinder can be expected to cycle numerous times during the life of the lift, and advantageously is durable and resistant to wear. A user has more confidence in a heavy duty lift structure than a light or wobbly one. Any looseness in the mechanical parts and in the operation of the drive causes shaking and a lack of security that is disturbing or possibly dangerous for persons using the lift. There are various ways in which lifts are designed to address problems associated with these and other aspects of structure, performance, longevity, expense, etc.

An example of some of the conflicts encountered in this design dilemma is shown by U.S. Pat. No. 5,261,779—Goodrich, which discloses an exemplary platform lift powered by an extensible drive cylinder and compares it to other lifts. The proximal member of the parallelogram is fixed to the vehicle so as to define two pivot points on a line that is inclined backward and upwardly relative to the plane of the doorway. Such an inclination has the result that if the parallelogram can be completely collapsed flat when the lift is raised, the linkage members will be disposed inwardly of the vehicle doorway. Another result, however, is that the drive cylinder needs to expand the parallelogram from its collapsed position to reach a point at which the platform is coplanar with the vehicle compartment floor, which point is then at an intermediate point along the arc traversed by the platform. The cylinder then needs to resist the force of gravity that operates to lower the lift. The cylinder has to operate in the opposite sense in raising the lift and finally stowing it within the passenger compartment.

The opposite members of the Goodrich linkage define a parallelogram in general, but the distance between the pivot points is not precisely equal on the opposite sides. As a result, there is a difference in the inclination of the platform between its raised and lowered positions. Specifically, when raised to the passenger compartment level, the platform slopes backward slightly, i.e., downwardly into the vehicle. When lowered to the ground, the platform slopes outwardly, i.e., downwardly toward the ground unless otherwise supported on the ground terrain. This sloping discourages accidental movement of a wheelchair onto the lift because such movement is uphill but is less positive than a barrier. The arrangement of the lift linkage members and the drive cylinder also has other implications.

Barriers are known for the purpose of preventing a wheelchair from rolling out of the vehicle department at an inappropriate point in the traverse of the wheelchair, namely when the platform is not coplanar with the floor of the passenger compartment. However such barriers need to be deployed whenever the platform is not located exactly and fully at this upward loading/unloading position. A barrier cannot be mechanically coupled to cycle together with the cycle of the lift, because the barrier would be only half deployed when the lift was halfway lowered, etc.

Lifts driven by drive cylinders (whether extended under power or retracted or both) require that the drive cylinder be attached pivotally at its opposite ends to some point on the parallelogram linkage members. The orientation of the drive cylinder relative to the parallelogram members changes as the lift traverses its arc. In Goodrich and in other similar lifts, the drive cylinder is coupled at its ends to the same pivot shafts at which the parallelogram members are also pivoted. This connection of the drive cylinder may seems appropriate, but according to the present invention a number of advantages are obtained by an improved arrangement for the parallelogram linkage members, the drive cylinder and the associated barriers.

SUMMARY OF THE INVENTION

It is an object of the invention to provide an optimized platform lift with a parallelogram mounting, for raising and lowering a load such as a wheelchair, between a ground level and a vehicle passenger compartment level.

A wheelchair lift is provided wherein a fixed posts and movable standards define opposite substantially-vertical parts of a parallelogram linkage coupled at four pivot points by parallel rotating arms, and the drive for the lift comprises an extensible cylinder mounted to apply force between points that are spaced from the pivot points between the arms and the vertical parts, at least on one end and preferably on both ends.

The drive cylinder has independent pivoting shafts at points of attachment located between the pivoting shafts coupling the parallelogram arms. The relative angle between the pivot attachments of the drive cylinder, versus the angle between the pivot attachments of the parallelogram members, is chosen to provide a particular combination of mechanical advantage and cylinder stroke length. This arrangement also has other advantages. For example the force and wear associated with the drive cylinder is borne by different pivot shafts (on one or preferably on both ends) than the pivot shafts forming the parallelogram linkage supporting the lift. Wear is substantially reduced.

The drive cylinder is inclined by an acute angle relative to the parallelogram arms. This enables operation with a moderate stroke and allows the cylinder to lift or lower the platform. When the lift is stowed in its upmost position, the parallelogram can be substantially collapsed flat, without requiring a corresponding accommodation for a particularly short drive cylinder. The drive cylinder in this collapsed position tends to pull and hold the parallelogram members securely collapsed, preventing vibration, and to pull the outer vertical standards into a nesting or coupling engagement with the fixed posts. In a preferred arrangement, the fixed posts in the vehicle doorway and the movable vertical standards carrying the platform, are provided with complementary male/female engagement structures that come into engagement when the parallelogram is collapsed. Thus the drive cylinder is arranged to pull these engagement structures together.

The preferred arrangement is substantially balanced by aligning the pivot points on the proximal vertical posts such that the pivot points of the parallelogram on the proximal side are on a line that is only slightly inclined inwardly toward the vehicle. Thus the vertical loading of the platform in the stowed position is minimal. When the platform is lowered for use vertical loading is increased. The platform cycles downwardly from the passenger compartment to the ground due to from gravity, extending the drive cylinder from a minimum length as stowed to a maximum length at the ground position. A variable choke valve can be provided to adjust the speed at which the lift falls due to gravity.

It is a further object of the invention to provide roll-off prevention barriers for the vehicle passenger compartment, associated with the lift, and operated by a mechanical linkage coupled to the lift. According to an inventive aspect, the barriers comprise pivoting gate members that rotate across the space between the fixed posts. According to an inventive aspect, the barriers are coupled with certain lost motion components such that the barriers deploy fully at the very beginning of the lift stroke. Although the lift has a relatively long stroke between its upper and lower extremes, the barriers are deployed immediately upon displacement of the lift platform from its uppermost position abutting the passenger compartment. According to another inventive aspect, the lost motion in the barrier couplings also permits the lift to proceed when the barriers are blocked, for example if the barriers deploy against an obstruction or onto a vehicle occupant located in the doorway.

According to additional aspects, the invention preferably has plural successive or parallel mounting aspects, operable independently, between the fixed posts and the load-carrying platform. On the load side, the platform pivots up for stowing or down for use. On the vehicle side, the posts are rigidly fixed at the lateral sides of the doorway. The posts and the vertical standards preferably nest together at male/female couplings, for example adjacent to each of the four corners of the doorway, which holds the vertical standards steady when the lift is retracted. The base member carrying the load platform horizontal pivot axis can be disengaged from one vertical standard to hinge on a journal post in the other vertical standard, permitting gate-like hinging to clear the doorway, preferably when the platform is rotated up from its horizontal load-carrying position into a vertical stowed position.

These aspects and objects are accomplished by a wheelchair lift according to the invention, to be mounted in a vehicle doorway at a passenger compartment. The platform part of the wheelchair lift can be raised and lowered around a horizontal pivot axis, into a stowed vertical position, and in that position can be rotated around the vertical hinge axis to clear the vehicle doorway for normal access without climbing over the platform.

A mounting structure having laterally-spaced fixed vertical posts is rigidly mounted in the vehicle doorway, inside the innermost (closed) position of the vehicle door. The mounting structure comprises vertical posts, preferably extending from the floor to the roof, with an upper header beam and a lower horizontal base member that frame the doorway together with the posts. Laterally spaced vertical movable standards are attached to the fixed posts by parallelogram linkages or arms and reside against the fixed posts in the retracted position of the lift. In the retracted position, complementary engagement structures engage between the vertical standards and the fixed posts. The engagement structures bear a lateral component of the load, and serve to position and align the vertical standards relative to the fixed posts. The engagement structures also define a stop position of the movable vertical standards as they are retracted against the fixed posts.

The drive for lifting and lowering the vertical standards relative to the posts comprises an extensible cylinder, preferably a cylinder on each side, attached at opposite ends between the fixed posts and the movable standards that are carried on the fixed posts by the parallel arms of a parallelogram linkage between the posts and vertical standards. The two parallelogram arms (preferably two on each side of the lift) comprise rigid members extending between pivot points on the posts and standards, respectively. The four pivot points form a parallelogram that expands and contracts for different positions of the lift.

According to an inventive aspect, the drive cylinder is attached at pivot points on the posts and standards that are between and spaced from the parallelogram pivot points. The cylinder is inclined relative to a line between the pivots mounting the parallelogram arms, which determines the mechanical advantage available to the cylinder and the length of its stroke during cycling of the lift.

The wheelchair supporting platform has at least three distinct modes of movement that can be effected sequentially for transferring a load in one direction or the other between the passenger compartment and the ground, or alternatively for clearing the doorway when the platform is stowed and not being used to carry a load. The platform is carried on parallelogram linkages holding the platform horizontal (when deployed) as the platform is raised or lowered between ground level and the level of the vehicle passenger compartment in one mode of movement. Preferably, this mode of movement is hydraulically powered. The hydraulic power can be adjustable, for example using an adjustable throttle valve between a hydraulic cylinder and a fluid pump or a fluid sump (or both), to adjust the speed at which the lift is raised or lowered, respectively.

The parallelogram linkages comprise at least two pivot arms attached at vertically spaced horizontal axis pivot points, between the fixed vertical posts and the movable vertical standards. The pivot arms and the posts and standards form a parallelogram between the pivot points. The parallelogram expands and collapses while moving the vertical standards and the platform it carries, through an arc around the pivot points on the fixed posts. The arc has a vertical span sufficient to move the load platform between the level of the passenger compartment and the ground adjacent to the vehicle, e.g. to a curb or to the street.

The specific layout of the parallelogram linkage and its dimensions relative to the vehicle are subject to variations, as shown in the prior art mentioned above, which is hereby incorporated. For example, the stowed position of the platform can be near top-dead-center on the arc, whereby the initial downward motion of the platform (or the final upward motion) is actually along a horizontal tangent. Preferably, the stowed position is slightly inward of top-dead-center, due to placing the pivot points on the fixed vertical posts on an inwardly inclined line so as to partly balance the weight of the lift when stowed. The weight of the platform is sufficient to balance the weight toward downward and outward movement, particularly when the platform is rotated from a vertical stowed position to a horizontal load bearing position.

According to an inventive aspect, however, the drive cylinder that drives and controls the motion of the lift is mounted in a particular arrangement wherein the force exerted by the cylinder is between pivot connections on the posts and standards along a line that is inclined relative to the parallelogram arms.

Due to the parallelogram mechanical connections, the standards remain parallel to the fixed posts. The parallelogram defined by the linkage collapses flat when the standards are retracted inboard toward the posts and expands when the standards are deployed outwardly and downwardly to lower the lift. The load supporting platform is pivotable on a horizontal axis on the inboard side of the lift to permit the platform to be raised from a horizontal wheelchair carrying orientation to a vertical stored orientation (defining the second mode of movement For horizontal axis pivoting the platform is attached to the movable vertical standards on a horizontal hinge axis coupled to one of the vertical standards on a vertical axis journal post. On the side opposite from the journal post, a clamping latch attaches the opposite end of the horizontal hinge axis structure to the other vertical standard, bearing part of the load on the platform. Thus the platform can be pivoted into a vertical position where the platform is substantially in the plane of the standards. The standards are retractable via the parallelogram linkage back toward the posts that are rigidly attached to the vehicle on lateral sides of the doorway, thus collapsing the thickness of the overall mechanism.

Pivoting of the platform on its horizontal axis can be permitted or prevented by means of a latch for locking the platform against the standards, in an embodiment wherein the horizontal pivoting is not powered. Preferably, however, pivoting of the platform is driven in either direction by an linear actuator such that the gate is not dropped suddenly when deployed and can be pivoted into the stowed vertical position without manual assistance. A latch is not necessary in the embodiment in which the horizontal pivot is powered.

A front roll-off gate and a rear roll-off gate can be associated with the platform. These respective gates deploy or are retracted due to contact between the platform and the vehicle (when the lift is raised to the passenger compartment) or between the platform and the ground (when the lift is lowered). The gates prevent rolling onto or off of the lift when the lift is at any other elevation.

Both the lost motion doorway barriers and side handrail members are mechanically linked to the respective parts for automatic deployment and retraction as a function of the relative positions of the parts. The handrail members are pivoted via a connecting rod relative to the horizontal axis of the platform. When the platform is parallel to the standards (i.e., vertical) the handrail members collapse between the platform and the standards, and when the platform is moved perpendicular to the standards (i.e., horizontal), the connecting rod raises the handrail members to a position perpendicular to the platform.

The doorway barriers are movably mounted to the posts of the fixed frame in the doorway to block passage by protruding into the doorway opening when the platform has moved away from the doorway sill by operation of the parallelogram linkage. One or more barrier members (preferably one on each lateral side) is coupled at a fixed post to a pivot pin or axis oriented parallel to the extension direction of the parallelogram linkage, and thus operable to guide the barrier gate(s) to a blocking position spanning the doorway or to rotate back around the pivot pin to a retracted position at the fixed posts or behind the fixed posts relative to the doorway opening. This motion is driven by connecting links coupled to the movable parallelogram linkage. A driving linkage is coupled between the barriers and the parallelogram linkage, such as a simple bell crank linkage.

The barrier gates move from their retracted position to their extended or blocking position immediately upon commencement of expansion of the parallelogram linkage from the upward position of the lift. In their extended or blocking position the barrier gates rest against limiting pins that are fixed relative to the fixed posts and define the limit of rotation of the barrier gates around the pivot pins. At this limit of rotation the barrier gates preferably extend substantially horizontally across at least part of the width of the doorway opening, and at an elevation high enough to block a wheelchair from rolling through the doorway. The barrier gates occupy their blocking position when the platform is not abutting or very nearly abutting against the sill.

The barrier members are operated by couplings connected to other movable parts of the device, in particular to the parallelogram link members. The couplings are arranged to provide the correct leverage or mechanical advantage to move the barrier gates into their blocking position immediately after the platform begins to move away from the sill. As the couplings continue to advance with movement of the platform toward the ground, the barrier members are displaced relative to the coupling that drives them, over a span of lost motion. Additionally, the barrier members are attached to the couplings through at least one spring, such that the barriers can be displaced safely through the span of lost motion and against the bias of the spring, if the advancing barrier members encounter an obstruction when moving into the blocking position.

Each barrier gate can have a hub mounted on a pivot pin fixed to the gate-like frame members, and around which the barrier gate and the hub rotate. The hub has a bell crank arrangement or eccentric coupling fixed to the associated movable member of the parallelogram linkage so as to transfer linear motion of the movable member to rotation of the hub on the pivot pin. The barrier gate is also rotatable on the pivot pin but is attached to the hub by a spring such as a helical spring. A stop spaced from the pivot pin defines the limit of advance of the barrier gate. The bell crank coupling rotates the hub as the platform moves away from the sill, thus moving the barrier gate by its spring connection with the hub, from a retracted position to an advanced position against the stop. As the platform moves further toward the ground, the hub continues to rotate but the barrier gate remains against the stop over the span of lost motion. Over the span of lost motion, the spring is displaced (e.g., the helical spring is wound more tightly). When the platform is later moved from the ground toward the doorway sill, the barrier gate remains in the blocking position against the stop (unwinding the spring) for the initial one-third of the up-cycle, whereupon the barrier is rotated around the pivot pin by its spring connection with the hub, and moved back into the retracted position for the remaining two-thirds of the up-cycle.

A number of variations are possible and will be apparent from the following discussion of practical examples and preferred embodiments as illustrated in the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
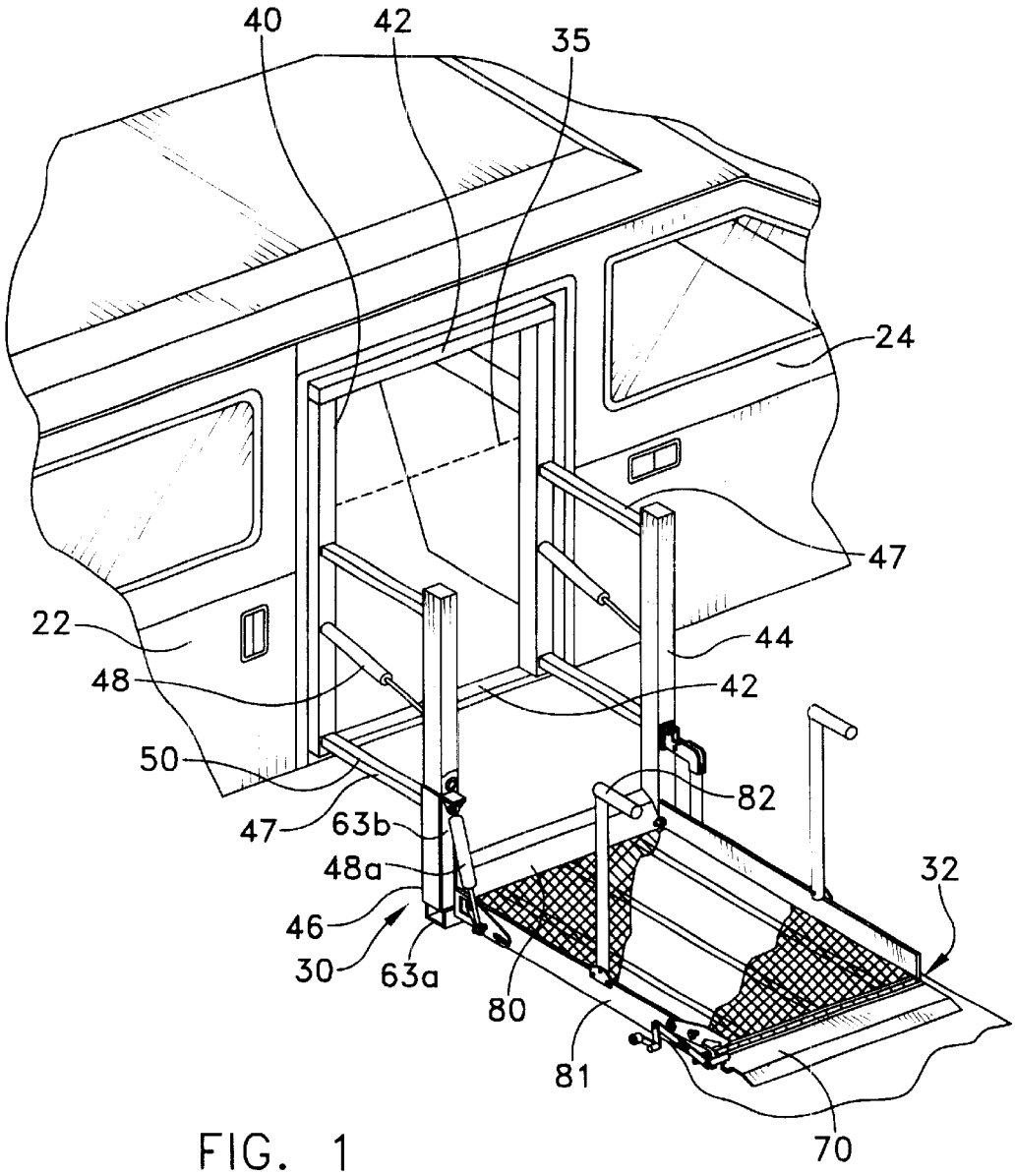
FIG. 1 is a perspective view showing the lift of the invention in a lowered position, mounted for example at the sliding side door of a van.
Figure 1A:
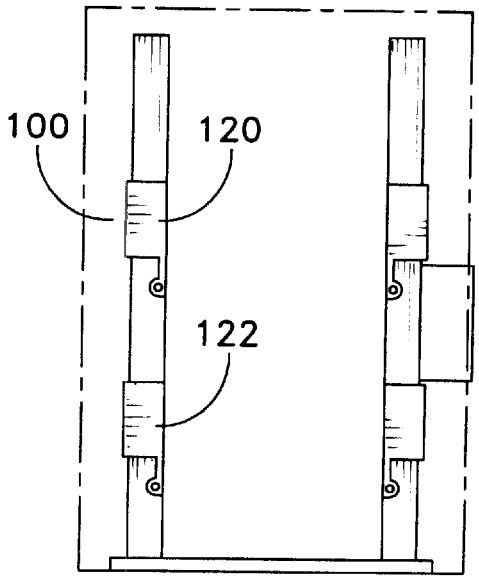
FIG. 1*a* illustrates the rear barrier arms of the invention in their vertical stowed positions.
Figure 1B:
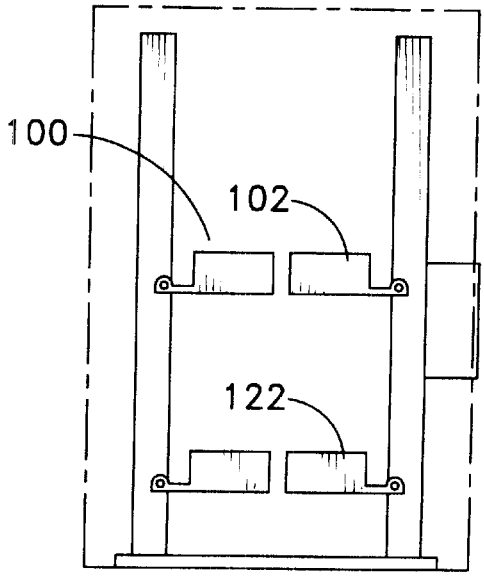
FIG. 1*b* illustrates the rear barrier arms in their horizontal deployed positions.
Figure 1D:
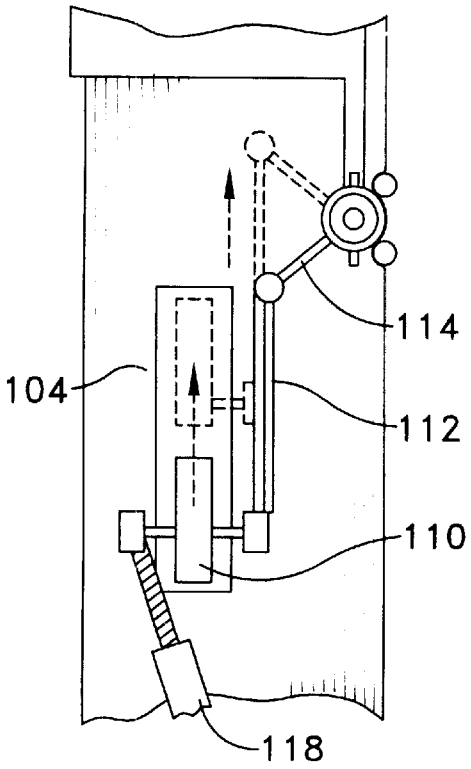
FIG. 1*d* is a detail elevation view corresponding to FIG. 1*c* and showing the upper linkages of the rear barrier mechanism.
Figure 1C:
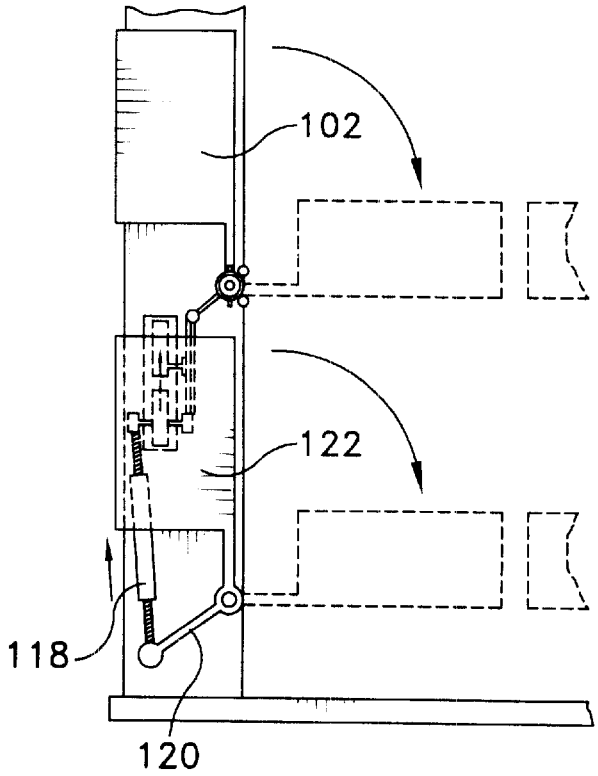
FIG. 1*c* is an elevation view showing the linkages of the rear barrier mechanism.
Figure 1E:
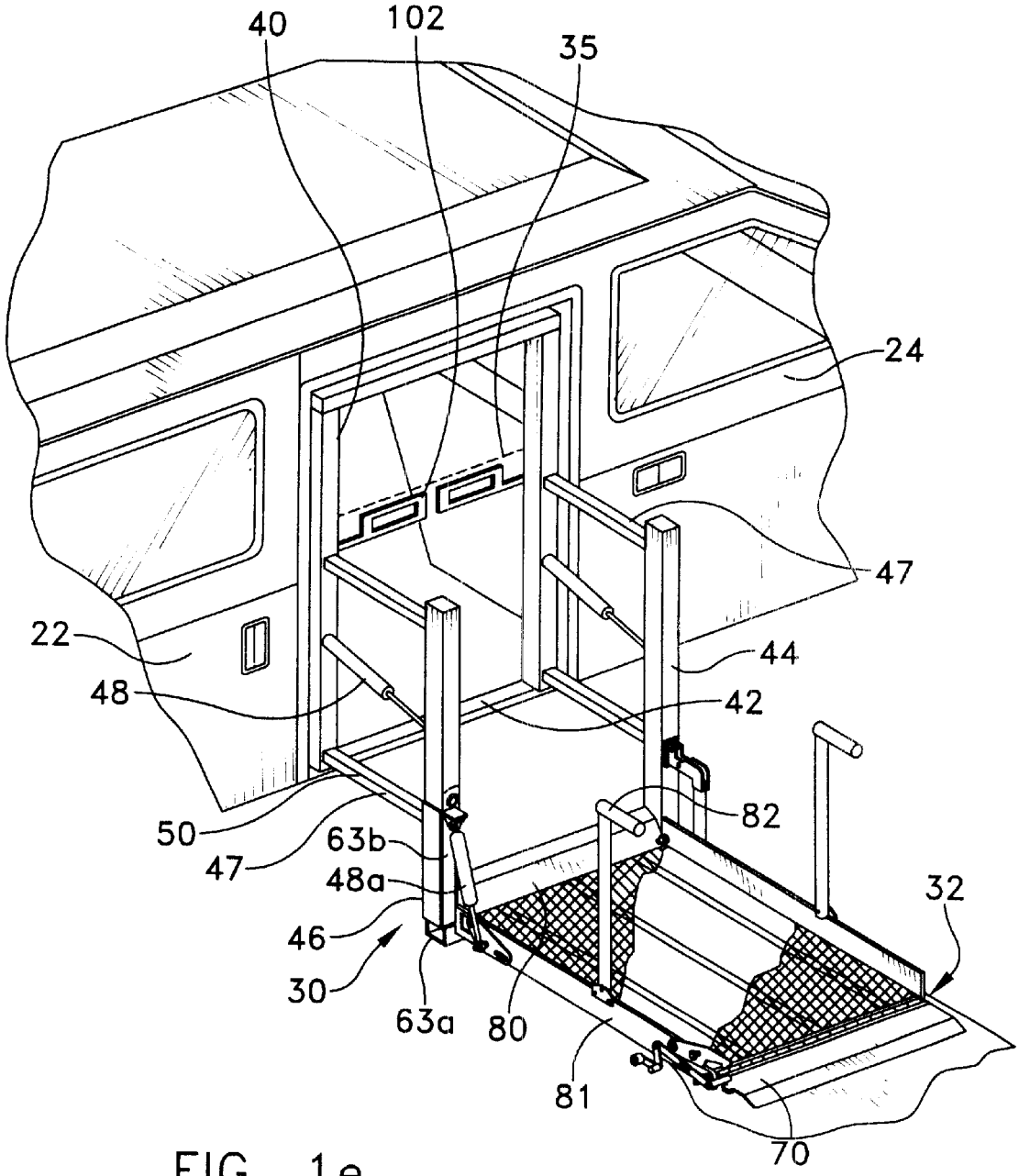
FIG. 1*e* is a perspective view corresponding to FIG. 1 and showing the lift with the rear barrier mechanism installed.

FIG. 1 shows the area of the side door 22 of a van 24, with the lift 30 of the invention in its lowered position as needed for a wheelchair (not shown) to be rolled on or off the platform 32 of the lift, in connection with transporting the wheelchair between a passenger compartment of van 24 and the ground, e.g., a street, curb, sidewalk or other surface adjacent to the van. In the arrangement shown, the lift is deployed laterally of the longitudinal axis 35 of the van or similar vehicle 24, and the wheelchair rolls onto or off of the platform in a direction perpendicular to the longitudinal axis 35 of van 24. The invention is also applicable to various types of doors and vehicles, for example with hinged doors or sliding doors, at the side or rear, arranged to enter and exit laterally or otherwise, etc.

In FIG. 1, the mounting structure for the lift comprises two laterally-spaced vertical posts 40 that are fixed or rigidly mounted in the vehicle doorway adjacent to the opposite sides of the opening defined by the doorway. The movable parts of the lift are carried on these fixed posts. The movable parts include a platform 32 that provides a horizontal surface to support the load and is pivotable on a horizontal axis relative to two movable vertical standards 44, which are in turn carried on the fixed posts 40 by members defining substantially a parallelogram linkage.

The mounting structure locates all the elements of the lift mechanism inside the passenger compartment and clear of the innermost (closed) position of the door when stowed. In other words, the lift retracts sufficiently that the door can be closed when the lift has been raised and the platform 32 is hinged upwardly on its horizontal pivot axis. When retracted and stowed, the platform 32 is pivoted upwardly from horizontal to vertical and the parallelogram linkage members 47 draw the movable vertical standards 44 upwardly and inwardly toward the passenger compartment, where standards 44 rest against and engage with fixed posts 40. Thus, when stowed, the vertically oriented platform 32, the retracted vertical standards 44 and the fixed posts 40 are sandwiched compactly against one another in a nearly coplanar arrangement across the opening of the doorway immediately inside the closed position of the exterior door.

In the vertical position of platform 32, the platform can be disengaged at its horizontal pivot axis from one of the movable vertical standards and hinged or swung on a vertical hinging axis adjacent to the other one of the movable vertical standards, in the manner of a gate. Accordingly, the stowed sandwiched elements occupy minimal space inside the vehicle, and are hingeable to clear the doorway to permit a person to pass through in a normal ambulatory fashion.

The mounting structure comprises vertical fixed posts, preferably extending substantially from the floor to the roof and securely attached at their ends to frame elements of the vehicle, and can be affixed, for example, to the "B" and "C" posts of the vehicle, which frame the doorway. Upper and lower horizontal beams 42 can be attached to the fixed posts 40 to complete framing of the doorway opening on all four sides. The vertical posts can be spaced slightly less than the full width of the doorway opening to provide clearance to insert the lift mechanism. The vertical posts can conceivably span only part of a wider doorway, for example the space behind one panel of a two-panel door, or part of the full space provided by a rear or side doorway.

The fixed vertical posts 40 support laterally spaced movable vertical standards 44 by means of two parallelogram link members 47 on each lateral side of the lift structure. The movable standards 44 are driven upward and/or downward by one or more hydraulic cylinders 48, over a span of motion defined by the parallelogram links. The parallelogram links substantially keep the movable vertical standards parallel to the fixed posts.

The hydraulic cylinders 48 extend or retract the lift by expanding or contracting the parallelogram defined by four members pivotally connected at spaced points such that opposite members are substantially parallel. In the embodiment shown, at least a length of the vertical standards 44 and a corresponding length of fixed post 40 are partially or exactly parallel and are connected by spaced parallel pivot arms 50. The two spaced pivot arms 50 remain parallel to one another and the vertical standards 44 remain parallel to posts 40. The movable standards 44 abut against the fixed vertical posts 40 in the most retracted position of the lift 30 and can be spaced from the fixed posts, at most, by the distance between the pivot points with pivot arms 50, which guide the vertical standards in an arc around the pivot connections between posts 40 and pivot arms 50.

Figure 15:
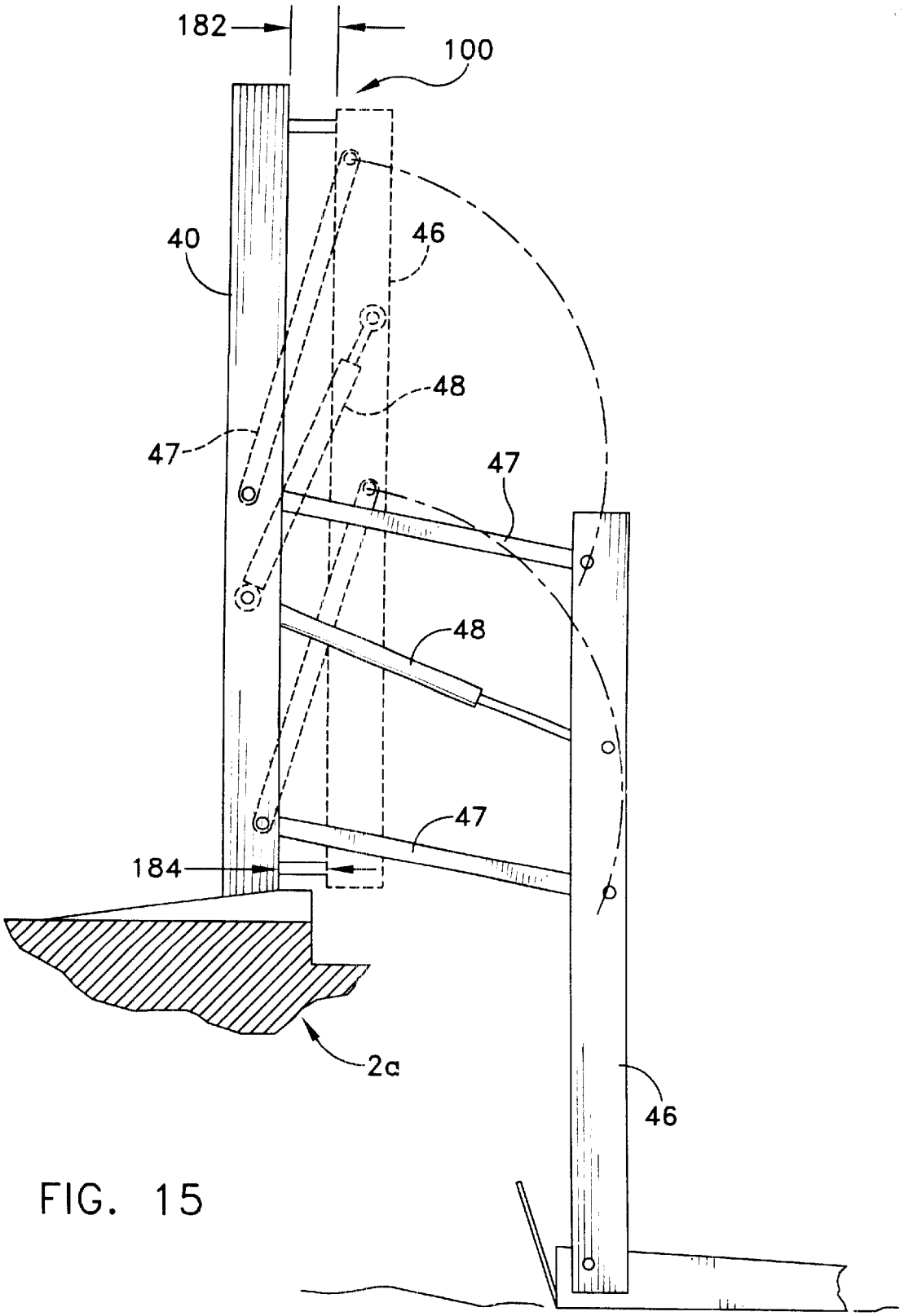
FIG. 15 is a side elevation corresponding to FIG. 14, illustrating relative positions of the connected elements in the raised and lowered positions of the lift, including the positioning of the movable parts and the drive cylinder.
Figure 15B:
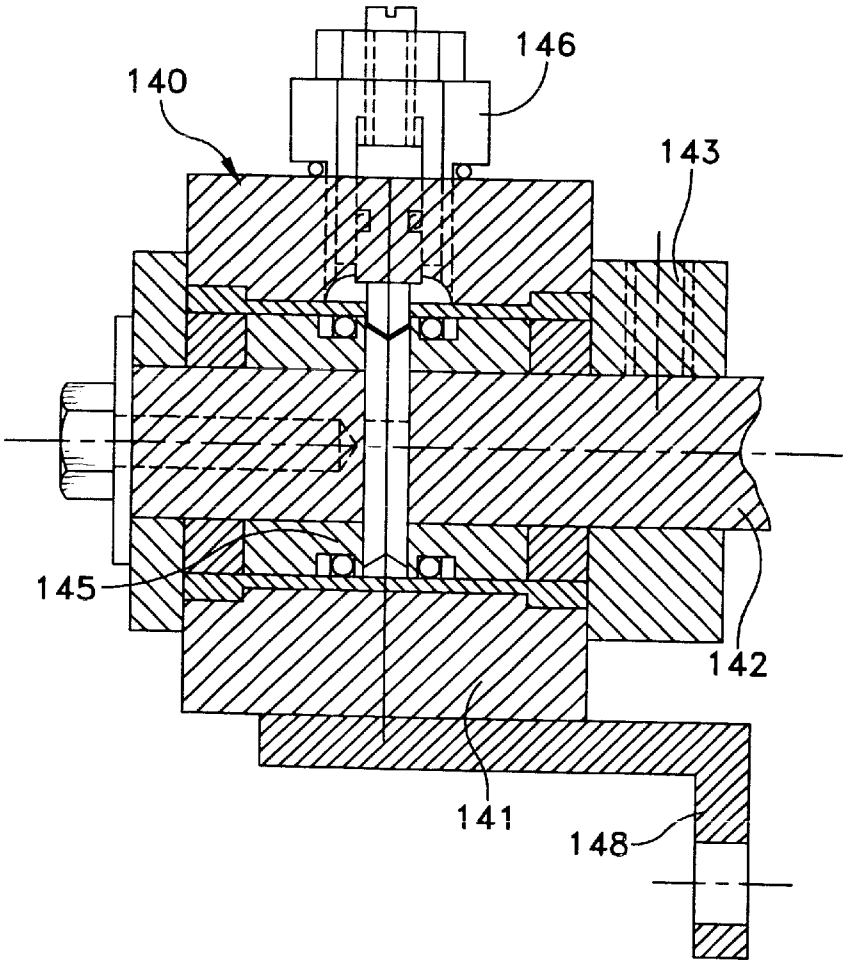
Figure 15A:
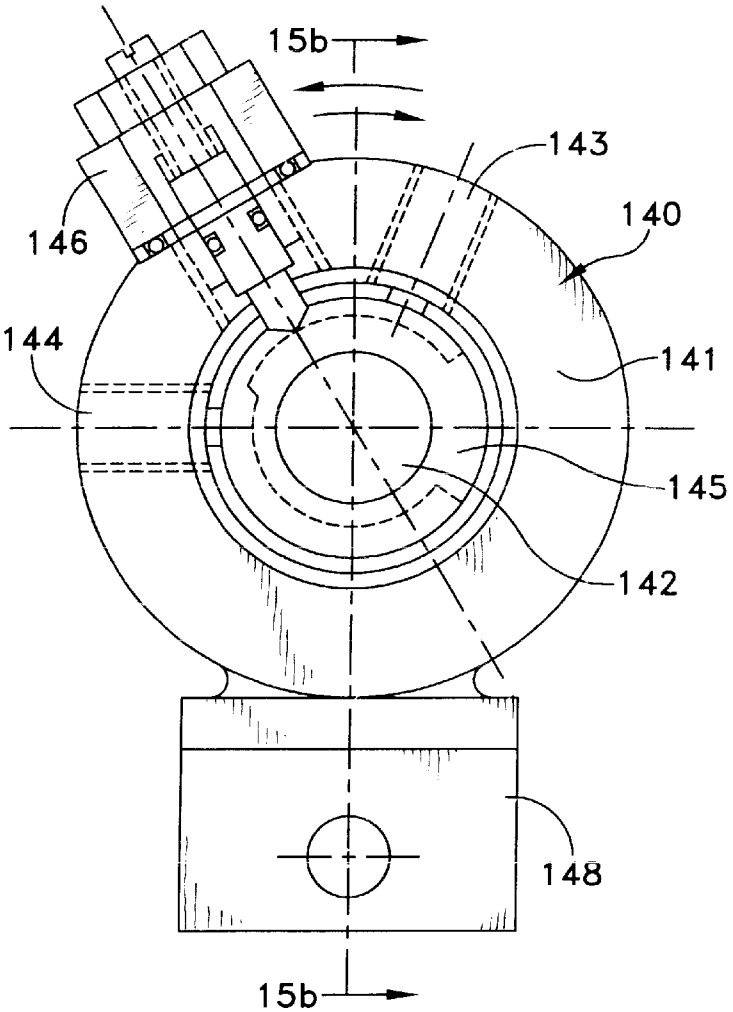

According to a preferred embodiment discussed with respect to FIG. 15, the vertical standards 44 are not precisely parallel to the fixed posts 40 and a line between the pivoted ends of parallelogram link members 50 is neither exactly vertical for exactly parallel on opposite ends of link members 50. Instead, these lines are arranged to tilt the movable vertical standards slightly inwardly when the lift is retracted. However, the tilt is slight and for convenience in this description, the posts 40 and standards 44 will be discussed as parallel and vertical. It should be understood that these designations are preferably approximate rather than exact, for reasons that are discussed below.

Platform 32 can be pivoted by a linear actuator motor 48*a*, e.g., having a screw drive and nut mechanism driven by an electric motor. Other types of actuators are possible, or in a simplified version the platform can be raised and lowered manually, possibly with the assistance of a gas cylinder to store energy for assistance in raising the platform on its pivot axis.

The parallelogram support of the lift preferably is raised and lowered by one or more hydraulic cylinders 48, two being shown in FIG. 1. One or more hydraulic or pneumatic cylinders and a suitable pump can be provided to absorb energy from the weight of platform 32 as the platform is rotated downwardly, and also to drive it upwardly under power.

The hydraulic drive cylinders 48 are coupled between the movable parts of the parallelogram linkage, such that the cylinders raise the lift by forcibly elongating or retracting points defined on the parallelogram members. This requires some design attention because the parallelogram collapses either in an upward or downward direction from its maximum expanded position at which the linkage members 50 are substantially perpendicular to the posts 40 and standards 44. In any event, vertical standards 44 and the supporting platform thereon are movable up or down in a curving arc that also varies the lateral position of the platform relative to the vehicle.

The cylinders 48 can be self-contained hydraulic types coupleable to a hydraulic pump (not shown). It is possible to arrange for all aspects of the lift to be driven by hydraulic power. However in a preferred embodiment, a hydraulic cylinder is coupled to the parallelogram linkage movement in a manner that can damp or brake the lowering of the lift by gravity, and positively drives the upward lifting movement of the parallelogram linkage. The pivoting of the platform on its horizontal axis preferably is driven by an electric linear actuator. The hydraulic pump can be a dedicated pump driven by an electric motor (not shown) using electrical power from vehicle 24. In a vehicle with an existing hydraulic system (not shown), the cylinders 48 can be coupled to such system by suitable control valves (not shown).

The lift mechanism provides several distinct modes of movement. These concern (1) deploying or stowing the platform by pivoting the platform on a horizontal hinge connection relative to the vertical standards, namely upwardly (to stow) or downwardly (to deploy); (2) moving the deployed platform up or down between the vehicle floor level and the ground by expanding and contracting the parallelogram to move the vertical standards in an arc relative to the fixed posts; and (3) hinging the vertically-stowed platform (preferably outwardly) on a vertical hinge axis located at one of the vertical standards to eliminate its obstruction of the doorway, or hinging the platform back between the vertical standards where the platform is locked in place by a latch.

In the first mode of movement, best illustrated in FIG. 1, the platform is carried in a horizontal orientation on parallelogram linkages 47 as the platform 32 is raised or lowered between ground level and the level of the vehicle passenger compartment by expansion or collapse of the parallelogram defined by the coupled posts, standards and pivot arms. This mode of movement is powered at least for raising the platform. For lowering, a one way throttle valve (not shown) can be provided to bypass the hydraulic motor to permit lowering. Alternatively, the hydraulic cylinder can be displaced by the hydraulic pump in both directions, even though gravity supplies substantially all the necessary energy in the lowering phase.

The parallelogram linkages (generally identified by reference number 47) comprise at least two pivot arms 50, and preferably comprise at least two arms 50 on each lateral side of the platform. The pivot arms are hingedly attached between the vertical posts 40 that are fixed in the doorway, and the vertical standards 44 that are movable to carry the platform 32. Two substantially parallel arms 50 extend between pivot points on a post 40 and standard 44 on each side. Thus there are four pivot point couplings with parallel axes, connected by four rigid members that form a-parallelogram whose apices are the pivot points.

The parallelogram has a fully expanded state in which the parallelogram forms a right rectangle. In the embodiment of FIG. 1, this occurs at a particular point in the span of motion of the lift, that may be near the position at which the lift is lowered down to rest on a curb or the like to receive or discharge a load. However, the parallelogram as shown can pass to a position in which the platform is lower than in the fully expanded state of the parallelogram.

In order to accommodate the span of motion in either direction from the fully expanded state, the embodiment shown does not couple the hydraulic drive cylinder between opposite pivot points on the parallelogram. Coupling between opposite pivot points generally provides the greatest possible span of movement and thus the most leverage or mechanical advantage for lifting. However, if the span encompasses a stowed starting position in which the parallelogram is substantially completely collapsed, and passes through and beyond the fully expanded position, it would be necessary for the drive cylinder to operate in expansion over part of its span an in contraction over another part. In order to better handle the span of movement, the drive cylinder of the invention is coupled between points that are intermediate between the pivot points at which the parallelogram members are coupled. The specific locations and angles are discussed below with respect to FIG. 15.

Figure 7:
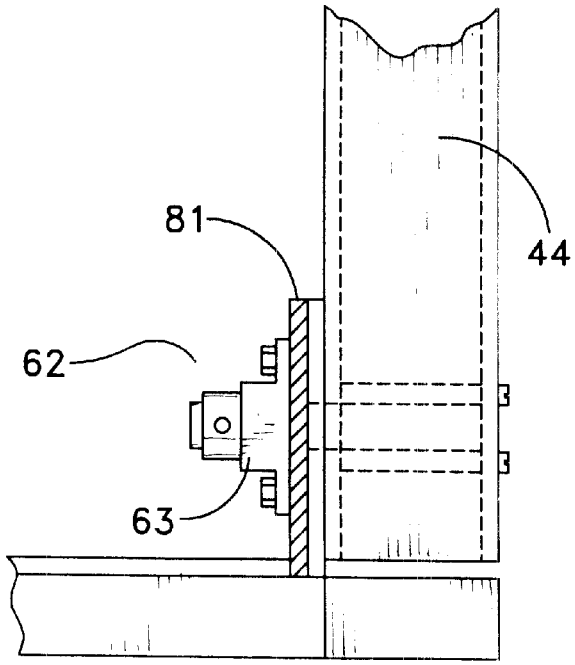
FIG. 7 is an elevation view of a typical horizontal hinging mechanism of the invention.

Connecting the drive cylinder at points other than the pivot connections of the parallelogram members has a substantial advantage with respect to concerns of durability and wear. In a connection in which the drive cylinder and the pivoted structural members of the parallelogram are mounted at the same pivot axis, the length of the means defining the pivot, such as a bolt or pin, must be shared by the structural parallelogram part and the drive cylinder part. For example, U.S. Pat. No. 5,261,779, which has been incorporated, illustrates a comparable prior art connection at FIG. 7. A parallelogram link member 118 and a drive cylinder rod 115 are coupled to a post (or possibly a standard) 119 at a common pivot axis defined by a pin or bolt 134. The post comprises a channel and the bolt 134 extends between the channel walls. The link member 118 and the drive cylinder rod 115 are coupled to the bolt 134 in the space between the channel walls. In such a conventional arrangement, bushing 115, 130 at a drive cylinder rod end occupies part of the length of a pivot bolt 134 between the channel walls, and two bushings 131*a*, 132*a* for parallelogram members 118 occupy the remainder of the length between the channel walls. As a result, each of these bushings is necessarily shorter than the full available span of the bolt 134 between the channel walls. The bushings are inclined to wear and become loose.

According to an inventive aspect, at least one end of the drive cylinder, and preferably both ends, are coupled to their respective parallelogram member (the post and the vertical standard in the example shown) at a pivot pin that is used only for the connection of the drive cylinder to the parallelogram member. Thus the at least one end is attached at a pivot point that is intermediate and spaced between the parallelogram pivots at the ends of the parallelogram members. This aspect is advantageous in that it permits an optimal configuration of drive cylinder stroke versus mechanical advantage, and also provides a substantially wear-resistant mechanical structure. As a result of connecting the drive cylinder ends to pivot pins that are separate from the parallelogram pivot pins, the connecting bushing for the drive cylinder can occupy the full available length of the pin at which the drive cylinder is attached. In the case where the drive cylinder attaches to a vertical standard or post that is formed as a channel, for example, the pin extends through the spaced channel walls, and the length along the pin between the channel walls is wholly devoted to the bushing for the drive cylinder. The length of the pin need not be shared by couplings for parallelogram members and the drive cylinder both, and instead is occupied by the drive cylinder end bushing and the structures provided at the channel walls, such as bushings or washers welded to the outer sides of the channels at an opening for the pin.

This can easily provide as much as three times the bearing area for the drive cylinder compared to a comparable arrangement in which the drive cylinder attaches at the junction of the parallelogram members. The inventive arrangement thus can cut the wear rate to a corresponding one third and/or multiplies the useful life of the coupling by three, compared to the conventional arrangement described. This resistance to wear is also realized in the pivot attachments of the parallelogram members, in that two rather than three members share the bearing surface provided by the pivot pin.

Referring again to FIG. 1, at the upward extreme of travel of the lift, the parallelogram is collapsed and the movable standards 44 are retracted inboard. The drive cylinder is coupled between pivot points that in this embodiment are on the fixed post and vertical standard, approximately midway along the vertical space between the parallelogram pivot points. However, the line between the pivoted cylinder ends is inclined downwardly slightly relative to a line between the adjacent pivots for the parallelogram members.

The drive cylinder continuously expands when the standards 44 are deployed outwardly and downwardly to lower the platform 32, both up to and beyond the point at which the parallelogram is fully expanded into a rectangle. One extendable/retractable hydraulic cylinders 48 is placed between the two pivot arms 50 on each opposite side in the embodiment shown. It would also be possible to provide only one cylinder such that the structure is driven on one side, or additional cylinders between or outside the parallelogram link members. One cylinder on each lateral side is preferred for smooth and even downward translation and upward powered lifting of the platform 32.

Figure 2:
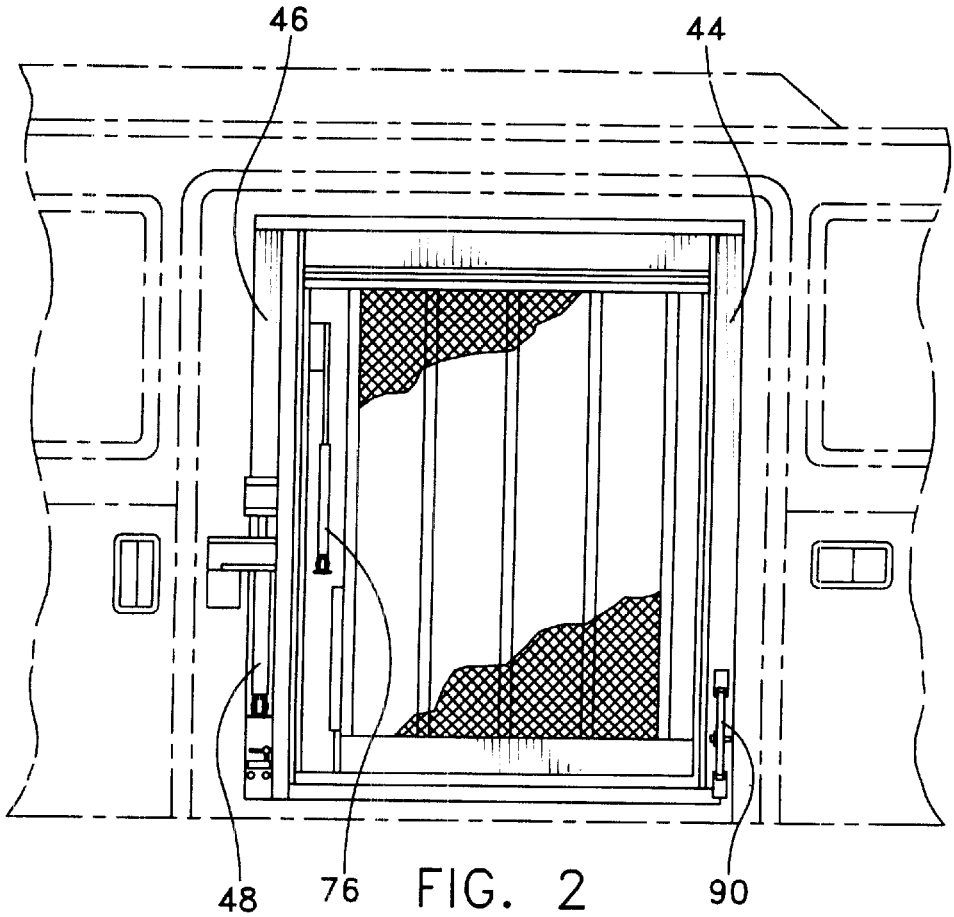
FIG. 2 is a side elevation view into the doorway, showing the platform of the invention in the vertical stowed position.
Figure 3:
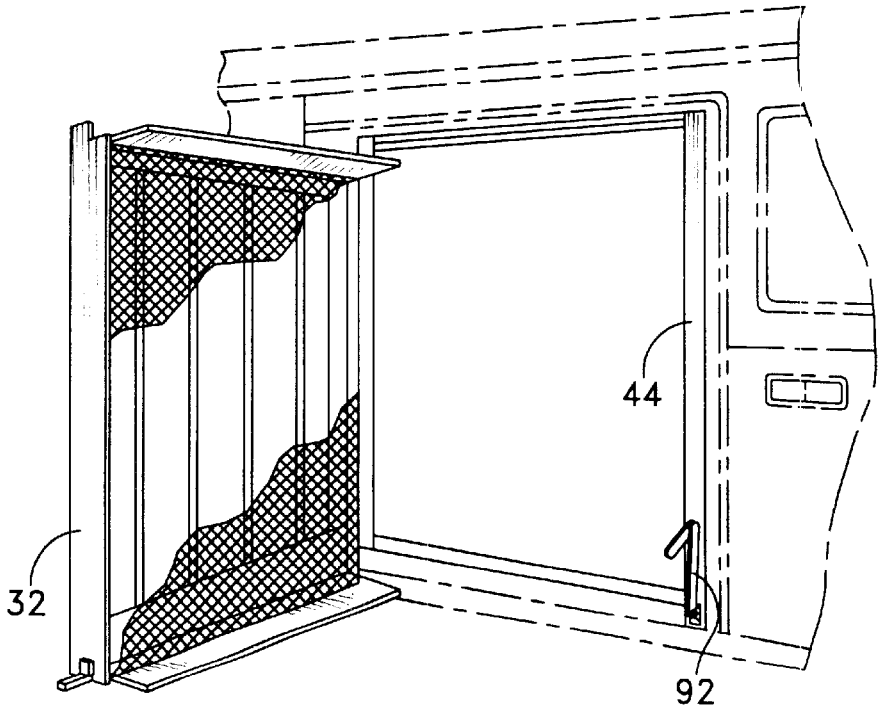
FIG. 3 is a perspective view of the lift, showing the platform swung clear of the doorway of the van.

FIGS. 1*a* through 1*e* illustrate certain safety barrier aspect of the invention. FIGS. 2 and 3 respectively show the closed and hinged-open gate-like operation of the lift when the parallelogram linkage is in its fully retracted and stowed position. In FIGS. 2 and 3, the load-carrying platform 32 has been pivoted upwardly and forms a panel across the doorway. The base plate 63*a* holding the platform is disengageable by a clamping latch mechanism 90, 92 on one vertical standard 44, and is carried on a heavy vertical pivot or journal post at the other vertical standard 46 (see also FIG. 6). The base plate and the platform 32 thereon thus can be pivoted outwardly like a gate between gateposts defined by the vertical standards 44, 46.

Figure 4:
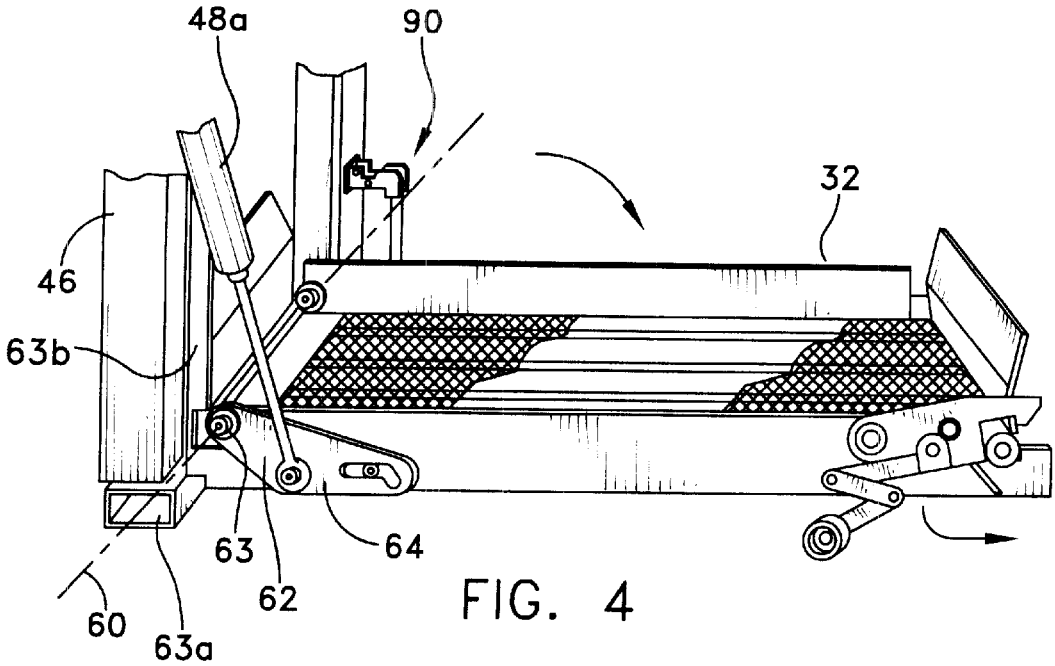
FIG. 4 is a perspective view showing the platform deployed and movable from its vertical stowed position to its horizontal wheelchair carrying position.

In FIG. 4, platform 32 is pivoted downward on its horizontal hinge 60. This places the platform 32 in a horizontal wheelchair-carrying orientation where it can be lifted to the level of the passenger compartment and lowered to the level of the surrounding terrain. The platform 32 is attached to the movable vertical standards 44 on a horizontal hinge axis 60 extending between the standards 44 and associated with a base plate 63*a*.

As shown in FIG. 4 and also in FIG. 1, the platform can be driven up or down by an extensible cylinder 48*a* such as an electric thread and nut positioning actuator. The cylinder is attached at its lower end to a whale 64, discussed below. At its upper end, the cylinder 48*a* is attached to an angle iron section 63*b* that is welded to the base plate 63*a* and therefore rotates together with base plate 63*a* on the axis defined by the journal post inside vertical standard 46 (not seen in FIGS. 1 and 4). The angle iron provides a point above the horizontal pivot or folding axis of the platform against which to pull with the cylinder 48*a*. This point for application of tension force is spaced from the point at which angle iron 63*b* is securely mounted, which is at a weld with base plate 63*a*. In order to provide a secure point for application of this force, the upper end or the angle iron is cut out to form a yoke that engages under the head of a bolt that is affixed to vertical standard 46. When the baseplate 63*a* and the attached angle iron 63*b* are rotated to the position shown in FIGS. 1 and 4, the yoke engages with the bolt. The bolt prevents the top end of the angle iron 63*b* from tending to be pulled outwardly away from vertical standard 46. Nevertheless, the baseplate 63*a* (and the angle iron 63*b*) are free to rotate on the vertical journal post. This disengages the yoke from the bolt. It is possible to fold and unfold the platform when the baseplate 63*a* is rotated open. It is also possible to rotate the baseplate open or closed with the platform in the folded open position. However it is recommended only to disengage and rotate the baseplate 63 open when the platform is folded up, which avoids a concentration of stress at the journal post at the bottom end of the hinge-side vertical standard 46.

In its vertical position, platform 32 occupies minimal space or thickness and thus space taken up by the lift inside the vehicle passenger compartment is minimized. Additionally, the parallelogram links are substantially fully pulled inwardly such that the parallelogram is collapsed to rest against the fixed vertical posts 44.

FIG. 4 shows horizontal hinge bearing 63, attached to a hinging base member or base plate 63*a*, which is attached to the movable vertical hinge standard 46. Base 63*a* is mounted to one of the vertical standards on a vertical journal post (see FIG. 6), and to the other vertical standard by a clamping latch (see FIGS. 5*a*, 5*b*). A supplement arm or whale 64 is attached to an end of linear actuator 48*a* to pivot the platform on a horizontal axis, having a slotted coupling whereby the whale pivots on a different axis from the platform (see also FIGS. 6–8).

The slot in the whale 64 forms a cam track as shown, for a pin extending from the sidewall of platform 32. The cam track has a downward/outward diversion at its outboard end. When folding the platform up from the horizontal position shown in FIG. 4, the pin in the platform sidewall slides initially along a straight length of the slot in the whale 64. The rate at which the platform raises is related mathematically to the displacement of the drive cylinder 48*a*, the angle of the cam slot, the positions of the hinge axes of the platform 32 and the whale 64, etc. The cylinder 48*a* is preferably a screw thread electric actuator operable at a constant speed (subject to loading). Preferably the platform is folded up or down quite briskly, so that the user does not have to wait for long while the unloaded platform moves to the desired position.

The downward/outward diversion in the cam track of whale 64, which in other respects is straight, adjusts the speed at which the platform folds. When the platform is being folded toward an upright stowed position, the diversion at the end of the cam track is encountered near the end of the platform's upward span of movement. This slows the rate of advance of the platform and prevents the platform from slamming shut when folded up.

In the lowered position shown in FIG. 4, the platform can be lifted quickly because a given rotational displacement of whale 64, attached to the bottom end of cylinder 48*a*, results in displacement of platform 32 related to the proximal part of the cam slot. The precise rate need not be constant, but according to the invention the rate is slowed near the upper extreme, where the folding rate drops off due to the diversion in the cam track. In addition to keeping the platform from slamming shut, into its full upright stowed position, the slot diversion also causes the initial part of the downward folding cycle to commence slowly when unfolding.

It would be possible to have a cam track that had speed adjustments at more that one point along the span of movement. For example, the cam could have a speed-change diversion near the open extreme of the foldable platform 32 (not shown). Alternatively, instead of one or more diversions, the cam track could be continuously curved so as to provide a progression of different speeds at different points along the fold/unfold cycles.

The upper end of actuator 48*a* is affixed in a manner that permits the platform structure to hinge on post 68. Bearing 63 can be affixed to rotate on a vertical axis on standard 46, and the upper end of actuator 48*a* can be affixed at a higher point than that, by means of an angle iron bracket 63*b* that is welded to the baseplate 63*a* and therefore is rotationally fixed to the baseplate. The baseplate 63*a* and angle iron 63*b* rotate as a unit carrying the platform, on the vertical axis journal disposed in vertical standard 46. The vertical standard itself, which supports the axle carrying the journal connection, is one of the parallelogram members and does not rotate.

The angle iron bracket 63*b* extends upwardly for a distance from the baseplate 63*a*, and provides a connection point for the top end of the platform-folding cylinder 48*a*. A yoke formation can be formed by the angle iron bracket at a space from the bottom end, for example near the connection with the platform cylinder, to reinforce the angle bracket an the cylinder. In the embodiment shown, a yoke is formed at the upper end of the angle iron bracket 63*b* at a position that engages under a bolt threaded into or welded to the vertical standard. The yoke engages under the head of the bolt, thereby fixing the top end of the angle iron to bear the force of the cylinder 48*a*, and also the cantilevered weight of the lift platform and its load when the platform is down.

A second bolt (not shown) can be provided at a position that bears against the backside of the angle iron 63*b* near its top end. By adjusting the bolt heads, the top of the angle iron at the yoke is captured under the head of the bolt in the yoke and against the top end of the bolt head behind the angle iron 63*b*, for minimizing displacement and vibration in either direction.

In the illustrated embodiment, the bracket 63*b* is provided as an angle iron and the yoke is formed by a lateral slot in one of the sides of the angle iron such that the yoke engages under the bolt when the baseplate and platform are hinged to extend between the vertical standards. Other specific bracket shapes and/or mounting structures are possible and should be apparent in view of the example shown. For example, a hemi-cylindrical section of tubing can be used instead of an angle iron. Instead of receiving the bracket under a bolt head using a yoke structure, a raised flange can be provided on the vertical standard to extend over the bracket for engaging over and reinforcing the bracket.

In another alternative (not shown), the post forming the journal can be supported on the vertical standard at both its upper and lower ends (or at least at two or more spaced points), with a vertically elongated bushing being rotatable on the and post forming a base member attached to the baseplate 63*a* at the bottom and to the upper end of the platform folding cylinder 48*a* above the bottom.

Figure 8:
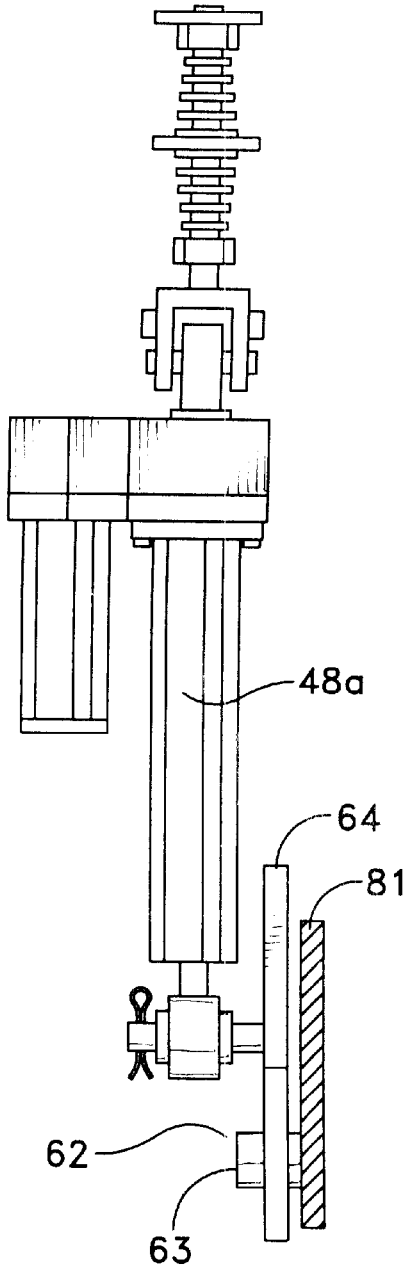
FIG. 8 is a detail elevation view showing the combination of the linear actuator and the horizontal pivot arm assembly.

At its lower end, cylinder 48*a* is attached to the whale 64 that is in turn attached to the platform side wall 81 by a pin on the platform, slidable in a slot in the whale 64. As shown in FIG. 8, the whale 64 is attached to the rod end of a platform-folding cylinder comprising a linear actuator motor 48*a*. The actuator could be omitted or replaced, for example, by a gas cylinder. However the actuator is preferred to prevent the platform 32 from dropping abruptly to its lowermost position during downward pivoting of the platform, and operates to pivot the platform upwardly to the stowing position. As shown in FIG. 8, a cushioning spring can be provided in the connection of the cylinder 48*a* to soften the descent of the platform and generally to cushion the platform's movements.

The point of the connection of the rod end of actuator 48*a* to supplementary pivot arm or whale 64 as shown in FIG. 4 is approximately at the same elevation as the sliding pin on the lowered platform. However the connection of whale 64 is on the outboard side (the lower side of the platform in FIG. 4) relative to a line between the main hinge bearing 63 and the sliding pin. As a result, when actuator 48*a* is retracted to its shortest length when lifting platform 32, the sliding pin is brought over to the inboard side of main bearing 63. Thus the platform passes slightly toward the inboard side of vertical, and tends to stay stowed by force of gravity. A supplemental locking latch (not shown) can be provided to positively lock the platform in an upwardly rotated stowed position.

Typical mounting and adjustment parts, such as a clevis, springs, bearings or bushings, washers, an alignment guide, etc., can be used to attach the working end of the actuator 48*a* to the whale 64. Horizontal hinge bearings 63 are provided on both lateral sides of the platform and define a horizontal hinge axis for the platform relative to the movable vertical standards 44, namely through the platform side wall 81.

As discussed above, the platform could be manually raised and lowered, optionally with the assistance of a gas cylinder or springs (not shown) to reduce the extent to which the platform could crash down into its horizontal position when opened, and/or to provide assisting force when lifting it back again. Similarly, linear actuator motor 48*a* can be preloaded somewhat to urge the platform 32 to rotate inwardly (i.e., up) when in the up position, for example by means of one or more springs or gas cylinders to offset part of the weight of the platform.

The platform 32 is hingeable on a vertical axis relative to the movable vertical standards 44 carrying the platform 32 and the parallelogram linkages 47. It is possible to swing the structure vertically on the hinge axis when the platform is horizontal, but the hinging movement is primarily intended to be made when the platform is pivoted upwardly, and operates to move the lift structure substantially out of an obstructing position across the doorway. The pivoting is much like opening a door or gate in which the platform occupies the position of the door or gate panel.

The invention accomplishes the respective motions, including hinging, platform deployment or stowing, and parallelogram lifting or lowering, by providing structures for these motions that are carried on one another. This requires a heavy-duty vertical hinging structure in the form of the journal post 68, shown in FIGS. 6 and 8. For example, the user could conceivably pivot open the platform, lower the parallelogram and disengage the platform clamping latch to pivot the platform structure on the journal post. The invention can bear this stress because the journal post (alone) can support the platform when hinged open. The journal post and the clamping latch together support the platform at opposite ends of the platform base plate when the platform gate structure is hinged closed and the clamping latch is engaged.

Figure 6:
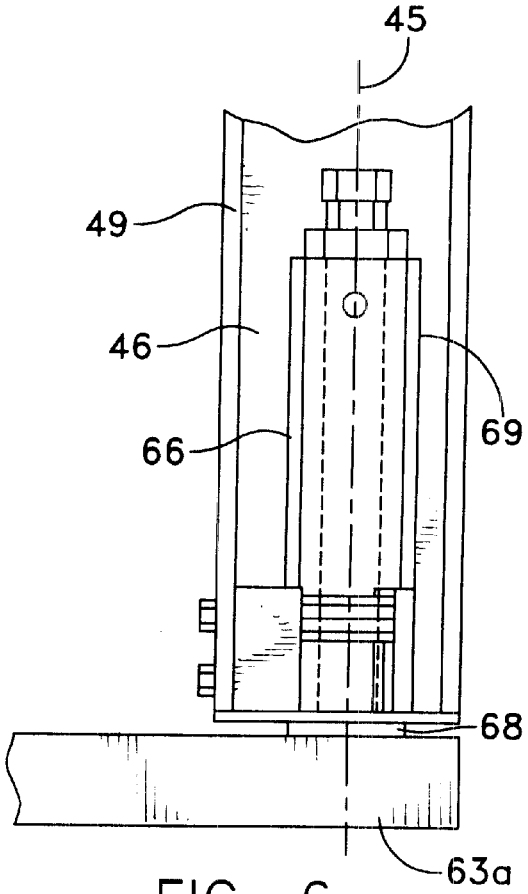
FIG. 6 is an elevation view of a typical vertical hinging mechanism of the invention.

The journal post as shown is located at the lower end of the inside of channel flanges 49 of movable vertical hinge standard 46. As shown in FIG. 6, a typical vertical hinging mechanism 66 consists of a hinge bearing 68 inside an elongated piece of pipe 69, the elongated pipe design providing the structural strength of the vertical hinging mechanism.

Figure 5A:
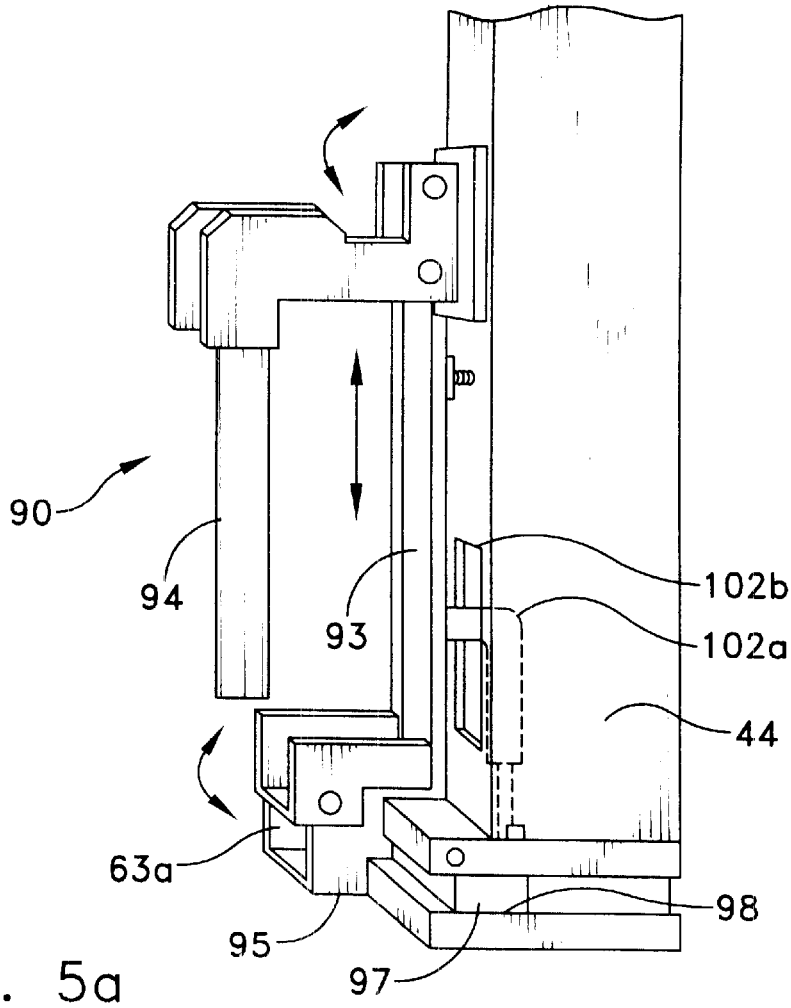
FIG. 5*a* is a perspective view showing the latching mechanism which allows the platform to be locked at the bottom of the vertically movable standard opposite from the standard at the vertical axis journal mounting.
Figure 5B:
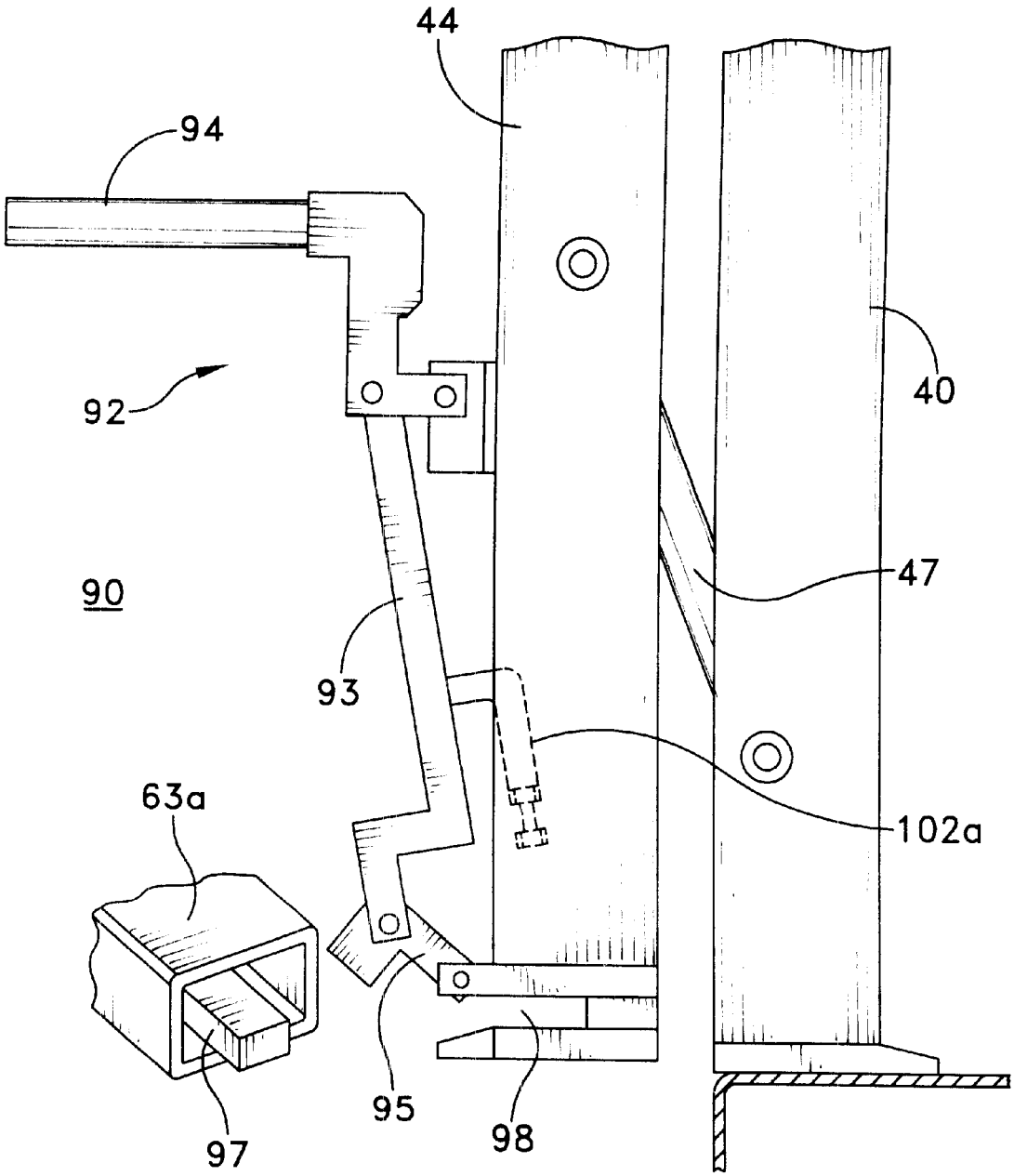
FIG. 5*b* is an elevation view corresponding to FIG. 5*a*, showing the relationship of the fixed posts, parallelogram linkage members, movable vertical standards and gate-like hinging of the folded-up platform.

FIGS. 5*a* and 5*b* show a secure clamping latch mechanism 90 by which the side of the platform base plate opposite from the journal post is locked to the movable vertical standard, thereby affixing the platform to the spaced movable vertical standards on both opposite sides. This clamping latch mechanism 90 preferably is manually operated and allows the platform 32 to be locked to the vertical standards as well as structurally affixed for supporting the various forces encountered. When disengaged, the latch mechanism 90 permits pivoting of the platform about the vertical pivot mechanism 66, shown in FIG. 6.

Figure 12A:
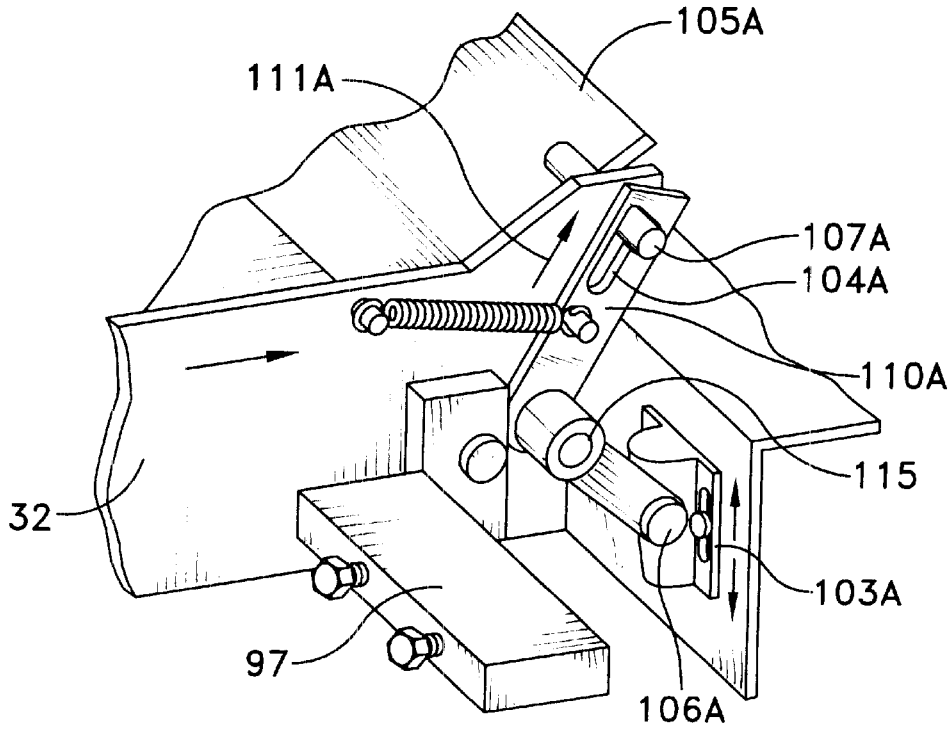
FIG. 12*a* is a perspective illustration of the inboard roll-off gate, shown closed.
Figure 12B:
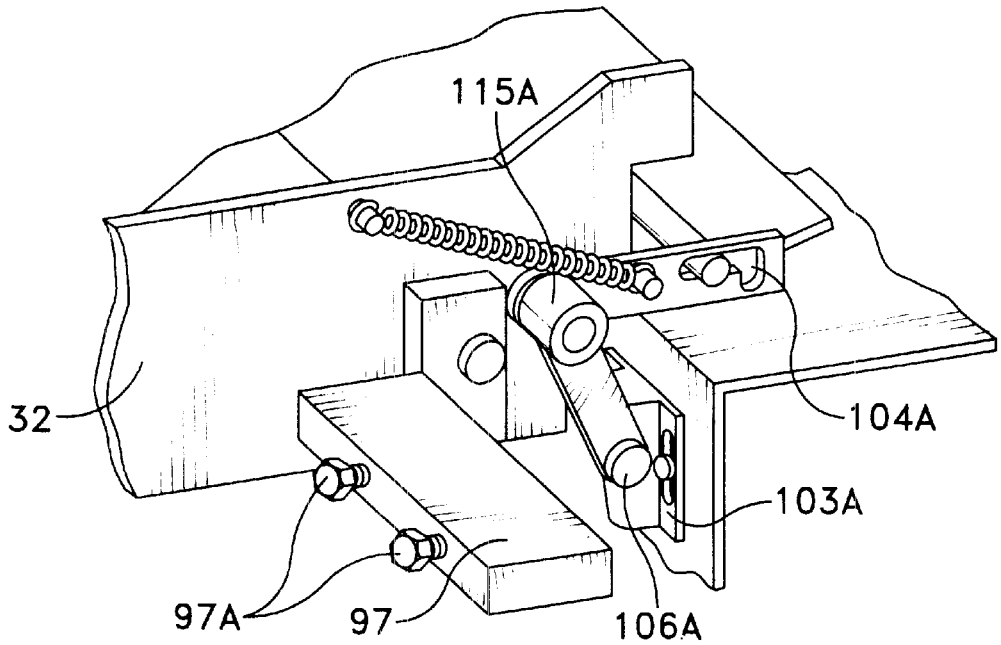
FIG. 12*b* is a perspective view corresponding to FIG. 12*a* with the inboard roll-off gate shown open.

As shown in FIGS. 3, 5*a*, 5*b*, the latching mechanism 90 has a latching arm 92 which is attached to the movable vertical standard 44 at a pivot point, the latching arm being movable by handle 94 and providing leverage or mechanical advantage. FIGS. 5*b*, 12*a*, 12*b* show details of the latch mechanism. A protruding bar 97 is attached to the platform 32, specifically protruding from the base tubing member 63*a* (see FIGS. 4 and 5*a*) to which the platform is attached on a horizontal axis. Tubing member 63*a* is the member that carries the platform (which also pivots up and down), while hinging on vertical axis 45 via the journal mounting shown in FIG. 6. A structurally sound connection is needed at the journal mounting to support the weight of the platform when hinged open around axis 45. A structurally sound mounting is also needed at the end of base tubing member 63*a* that is opposite from the journal mounting, to adequately support the platform when pivoted up and down. The latch mechanism (FIG. 5*b*) provides a robust and structurally supportive connection.

A protruding bar 97 is welded to base tubing member 63*a* and pivots together with the base tubing member 63*a* and the platform pivoted thereto, around hinge axis 45 in the manner of a gate. Protruding bar 97 provides a tenon-like member at the free end of this gate that is laterally received in a clamping keeper mechanism in FIGS. 5*a*, 5*b*. For locking the platform in a position in which the lift can be deployed, the protruding bar 97 is received in the receptacle or keeper welded to the bottom of the movable vertical standard 44. An L-shaped clamping arm 102*a* is formed integrally with or affixed to a push rod 93 and is received in a vertical slot 102*b* formed in the front of vertical standard 44. As latching arm 92 is pushed downward manually, thereby lowering push rod 93 with some mechanical advantage, clamping arm 102*a* is caused to rotate inward and to move down along slot 102*b*. The bottom end of clamping arm 102*a* presses vertically downwardly against protruding bar 97 to secure bar 97 and base tubing member 63*a* in position by vertical clamping. At the same time, the downward movement of push rod 93 causes the rotatable contact member 95 to rotate on its pivot (counterclockwise in FIG. 5*b*). This causes contact pad 95 to bear horizontally inwardly against protrusion 97 of base tubing member 63*a*. Clamping arm 102*a* is preferably length adjustable by a bolt and lock nut as in FIG. 5*b*. Contact pad 95 can also be adjustable by providing a bolt or the like (not shown) to precisely set the point at which contact pad 95 bears against protrusion 97. By setting these adjustments at positions such that clamping arm 102*a* and contact pad 95 are both at their full extension against protrusion 97 at the point at which latching member 92 and manual operator 94 thereof are centered at their maximum downward position, latching member 92 can be forced over center into a stable and fixed locking position in which protrusion 97 and thus base tubing member 63*a* are solidly and structurally engaged at the vertical standard opposite from the vertical standard carrying the journal mounting.

To release platform 32 to hinge or rotate out of its position blocking the doorway, the latch handle 94 on the latching arm 92 is lifted (pulled outwardly in FIG. 5*a*). This raises an elongated push rod 93 and integral clamping arm 102*a*, and draws rotated contact pad 95 outward and upward from the receiving opening 98 for protruding bar 97, freeing bar 97 and allowing the platform to hinge out of the doorway on the journal post on the opposite side of the platform. Contact pad 95 is L-shaped and is pivoted above the opening 98 such that linear downward displacement of push rod 93 forces the L-shaped contact pad 95 to rotate (counterclockwise in FIG. 5*a*) and hold bar 97 tightly in opening 98. The clamping latch is shown open in FIG. 5*b*, namely with handle 94 pulled outward, raising push rod 93 and clamping arm 102*a*, and rotating contact pad 95 away from receptacle 98 to free bar 97. If the adjustments are precisely set as discussed above, pulling handle 94 outwardly requires exertion of force to pass through the dead center position of the linkage, whereupon handle 94 swings up freely and disengages clamping arm 102*a* and contact pad 95, allowing the folded-up platform, carried on base tubing member 63*a*, to swing out like a gate.

A front roll-off gate mechanism 70, rear roll-off gate mechanism 80 and side handrail members 82 provided as shown in FIG. 1 and are arranged automatic deployment and retraction due to relative motion of the parts or by contact with the ground or the vehicle passenger compartment. The roll-off gate mechanisms operate to prevent a wheelchair from moving off the platform 32 except when the platform is resting on a horizontal ground surface (which opens the outboard roll-off barrier 71) or resting against the passenger compartment (which similarly opens the inboard roll-off barrier).

Figure 11A:
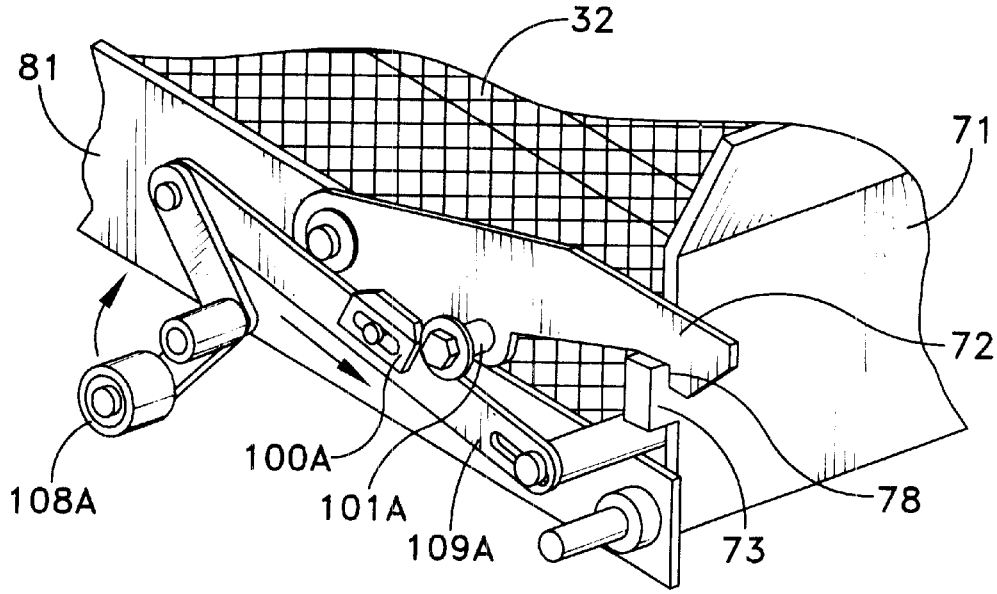
FIG. 11*a* is a perspective view showing an alternative embodiment of the outboard roll-off gate, shown closed.
Figure 11B:
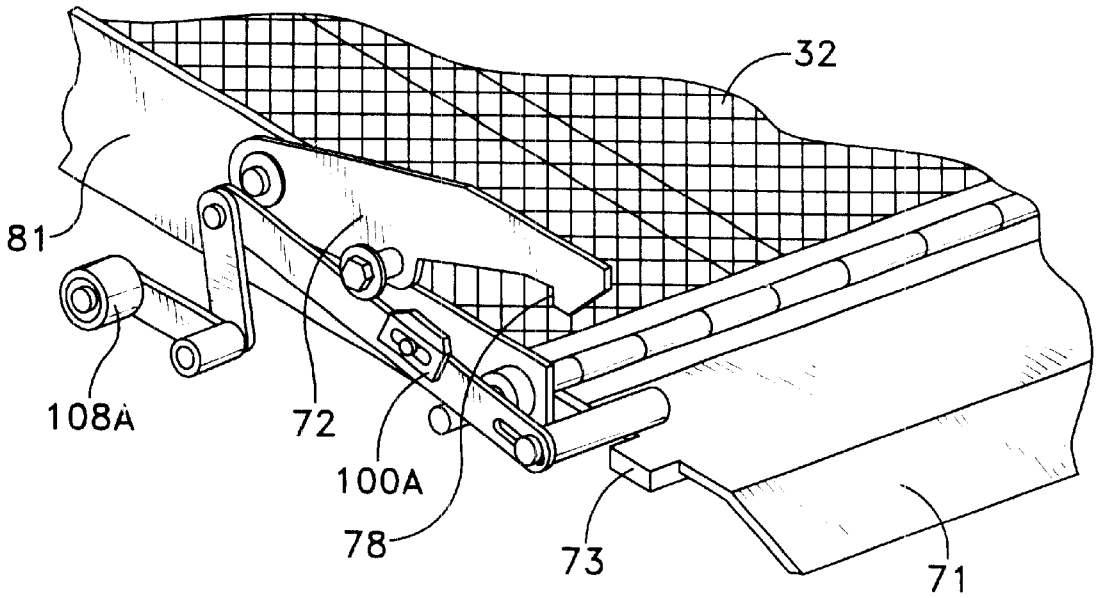
FIG. 11*b* is a perspective view corresponding to FIG. 11*a* with the roll-off gate opened by contact with the ground.

The front or outboard roll-off gate mechanism 70 has a biased latch 72 operable to keep the gate barrier 71 raised when the platform 32 is not in contact with a horizontal surface, and is opened by contact with the horizontal surface. FIGS. 11*a* and 11*b* show the closed and open state of the outboard or ground-operated gate, and FIGS. 12*a* and 12*b* show operation of the inboard or sill-operated gate.

The barrier 71 on the outboard side comprises a metal strip extending along the edge of the platform, hinged on a horizontal pivot axis and having a protruding end 73 spaced radially from the pivot axis. When the gate is closed, the protruding end 73 is captive under a safety latch dog 72 with a hook-like abutment 78 that drops over the protruding end 73 to dog the gate 71 in the raised position, positively holding the gate closed when the platform is not resting against the ground. This positive latching mechanism is preferred over holding the gate only by spring bias, because a spring could be overcome by rolling against the gate with sufficient force, whereas the dogged latch cannot be overcome in that way. The barrier 71 is attached to a link bar 109*a* disposed at a space from the pivot pin engaging the flanged side of the platform. A roller member is mounted to the platform flanged side to rotate around another pivot pin, and the roller member is attached to the link bar 109*a* at the end opposite from its connection to the barrier 71. When the gate is closed (FIG. 11*a*) a lateral protrusion 101*a* of the latch dog 72 rests over the link bar 109*a* and the latch dog abutment or stop part 78 engages the protruding end of the blocking member or barrier 71. As the lowering platform nears the ground, contact with the ground by roller 108*a* pivots the roller member clockwise on its pivot, advancing link bar 109*a*. Cam 100*a* pushes against roller 101*a*, which raises safety latch 72 to un-dog tab 73 of blocking member 71 of the gate. Advance of link bar 109*a* toward the opening direction of the blocking member 71 (FIG. 11*b*) causes blocking member 71 to open (rotate downwardly). Initially, the blocking member 71 is stationary and an integrally formed pin rides toward the back of a slot in arm 109*a*. When the pin reaches the back end of the slot, barrier 71 hinges open, permitting a wheelchair to enter or exit platform 32. A torsion spring 120 or the like operates to return the gate to a closed position when not urged open as described, permitting the latch dog to re-engage.

Figure 9:
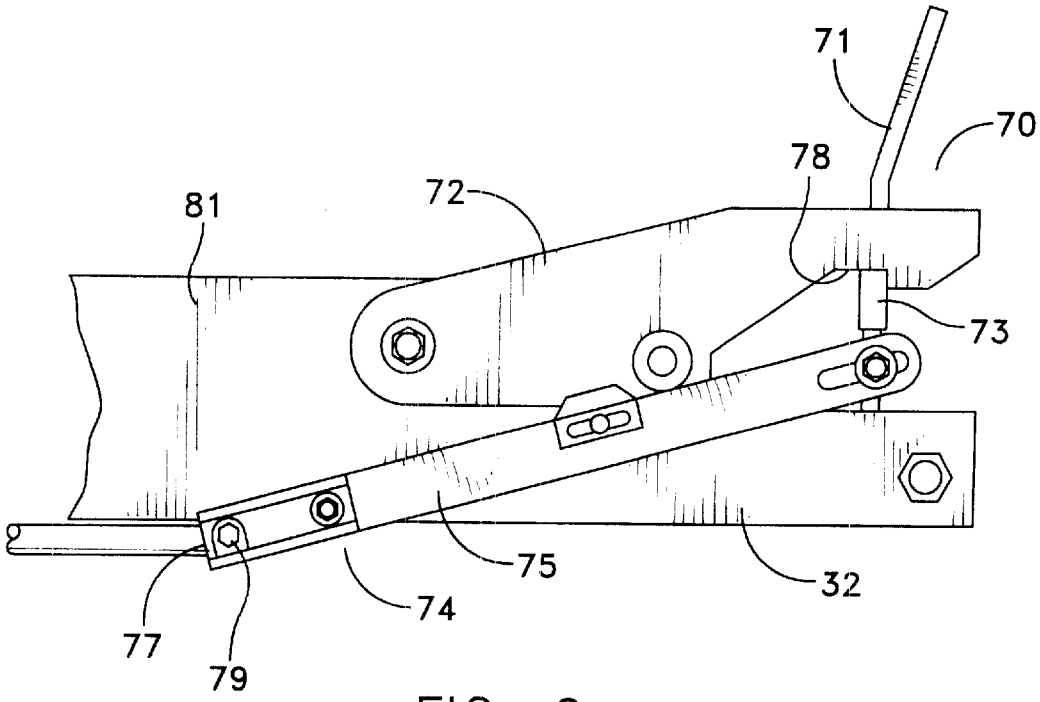
FIG. 9 is a detail elevation view showing the front gate mechanism closed.
Figure 10:
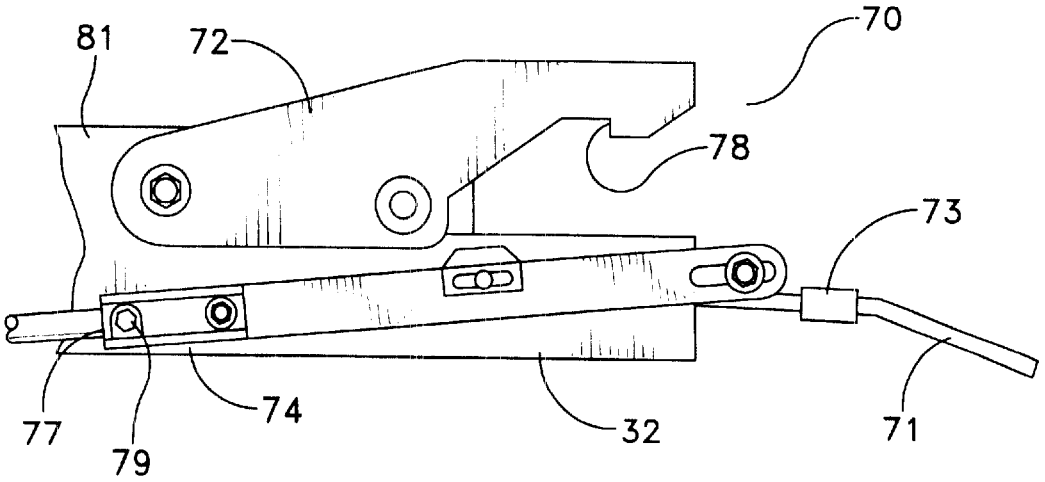
FIG. 10 is a detail elevation view showing the front gate mechanism open.

FIGS. 9 and 10 illustrate the operation of an alternative front gate mechanism 70, which comprises an actuator (not shown) attached to advance or retract contact arm 75. The front gate mechanism 70 comprises a horizontally pivoted gate or blocking member 71 coupled to one end of a contact arm or link member 75 on a side flange 81 of the platform. The opposite end of the link member is coupled to a bolt affixed to the blocking member. In this case a hydraulic, pneumatic or electrical actuator to pull the gate 71 into a blocking position (i.e., toward the left in FIGS. 9 and 10 biases the link member or contact arm).

FIGS. 12*a*, 12*b* illustrate an alternative inboard roll-off gate mechanism. Gate 105*a* is also operated (lowered) by contact between the mechanism and a roller, specifically roller 106*a*, but in this case roller 106*a* is positioned to come into contact with a wedge shaped adjuster 103*a* that can be vertically displaced and fixed to set the lateral point at which roller 106*a* begins to be displaced to commence lowering of the gate 105*a*.

Roller 106*a* is mounted on one end of an L-shaped link bar 110*a* which is secured to a sidewall of platform 32 by a pivot pin 115*a*. In this case a tension spring placed at a space from pivot pin 115*a* serves to return gate 105*a* to its raised position. Like the outboard gate, however, the mechanism has a positive stop against opening by a force from the platform side, as might occur if a wheel chair rolls against gate 105*a*. As platform 32 approaches contact with the van due to motion of the parallelogram linkage, the roller 106*a* contacts adjuster 103*a* causing link bar 110*a* to rotate (clockwise in FIG. 12*a*) about pivot pin 115*a*, against the tension spring bias.

The inboard side gate 105*a* includes an integral pin 107*a* which is received in an L-shaped slotted aperture 104*a* provided near the end of the link bar 110*a* on the side of pin 115*a* opposite roller 106*a*. As link bar 110*a* rotates clockwise, the portion of the link bar containing L-shaped slotted aperture 104*a* moves downward causing gate pin 107 to translate inside slot 104*a*, whereby the inboard gate 105*a* is lowered to provide access to and from the platform 32. The link member 110*a* on each end is coupled by a spring to the respective side flange of the platform 32, which in conjunction with springs 120 around axis 60 provides sufficient force to retract the inboard gate to its closed position, as platform 32 moves away from sill 42. The inboard gate 105*a* is likewise retracted under the force of the springs when platform 32 is swung out of the doorway about its vertically hinged axis, causing roller 106*a* to pull away from actuator 103*a*. When inboard gate 105*a* is fully retracted, pin 107*a* comes to rest in the bottom of a short arm of the L-shaped slotted aperture 104*a*, which acts as a positive latch to secure the gate 105*a* in place (see FIG. 12*a*). If downward pressure is applied to inboard gate 105*a* in this position, the tendency of pin 107*a* to move outward will be prohibited, and the force of pin 107*a* against the wall of the slotted aperture will increase, causing the short arm of the slotted aperture to latch harder against the pin 107*a*. Thus, when the inboard gate 105*a* is retracted, link bar 110*a* provides a secure latch to prevent the gate from lowering, which can be released only by applying a force to roller 106*a*, and not by rolling a wheel chair against the gate. As shown in FIG. 12*b*, the inboard gate 105*a* also functions when open as a ramp or transition member between the platform and the interior of the passenger compartment above the sill.

Adjuster 103*a* is wedge shaped and can be moved vertically up or down with respect to the front of the doorway sill to set the limit the travel of the inboard side gate 105*a*. For example, moving adjuster 103*a* up will limit the downward movement of inboard gate 105*a*. Thus, the adjuster position can be set to ensure that inboard gate 105*a* will rest again sill 42, for smooth wheelchair transfer on and off the platform.

FIG. 1 also shows a preferred side handrail structure. Side handrail 82 is hingedly attached to a platform side flange wall 81 on one end, and attached via a link member to pivoting base 63*a*. The handrails 82 are linked in this manner for automatic deployment and retraction together with the platform 32. As the platform 32 is lowered to its horizontal wheelchair-carrying orientation, the handrails 82 are rotated into an open positions extending vertically upward from the platform and having horizontally oriented handholds at the upper ends. As the platform 32 is rotated upwardly to its vertical stowed position, the handrails 82 likewise retract to their closed positions, folding between the platform sidewalls 81 and the fixed vertical posts 40.

FIGS. 1*a* through 1*d* illustrate details of a multi-part access barrier safety gate that deploys automatically to place one or more barrier members across the opening of the doorway when the platform is moved downwardly. The inventive barrier is mechanically coupled to the moving parts of the lift. Several linkages 104 can be provided to couple together four gate members (FIGS. 1*a*–1*c*) of the rear barrier mechanism 100 in the embodiment shown. Alternatively, at least one barrier gate, or preferably a pair of oppositely disposed barrier gates (FIG. 1*e*), obstruct passage when the platform is deployed and keep a wheelchair or ambulatory person from accidentally moving through the doorway when the platform is in any position other than coplanar and adjacent to the floor of the passenger compartment.

The rear barrier linkage mechanism can have a tension spring (not shown) for each movable barrier gate member, biased to rotate the respective barrier arm 102 into the advanced or obstructing position. Preferably the advance of the barrier arm is limited against a fixed stop pin protruding from the fixed vertical posts. When the lift is rotated downwardly by expansion of the parallelogram linkage, a stroke arm 110 coupled to a parallelogram pivot arm 50, is displaced upwards. Connecting member 112 couples this translation via a bell crank 114 on a cam. Barrier arm 102 rotates part way around its mounting pin, and then abuts against a stop pin limiting its rotation to a position in which the barrier arm 102 obstructs the doorway, for example to a horizontal position. The cam arm 114 can rotate further until the stroke arm 110 meets the limit of its displacement, namely when platform 32 is at its lowest elevation. The parallelogram can be arranged to limit the downward displacement of platform 32 to the nominal elevation of the ground, but preferably has a lower limit that is somewhat below the nominally expected ground level, to accommodate uneven terrain such as might be encountered in attempting to discharge a passenger when the vehicle is at a curb level and the discharge point is the ground or other surface at a lower elevation.

When the wheelchair lift is retracted and the platform is lifted upwardly toward the stowed position, barrier arm(s) 102 stays in a substantially horizontal blocking position resting against the fixed stop, until the lost motion in the barrier arm mounting is taken up, preferably when the platform is part way to its retracted position, docked against the edge of the passenger compartment, for example a third of the distance.

Figure 13:
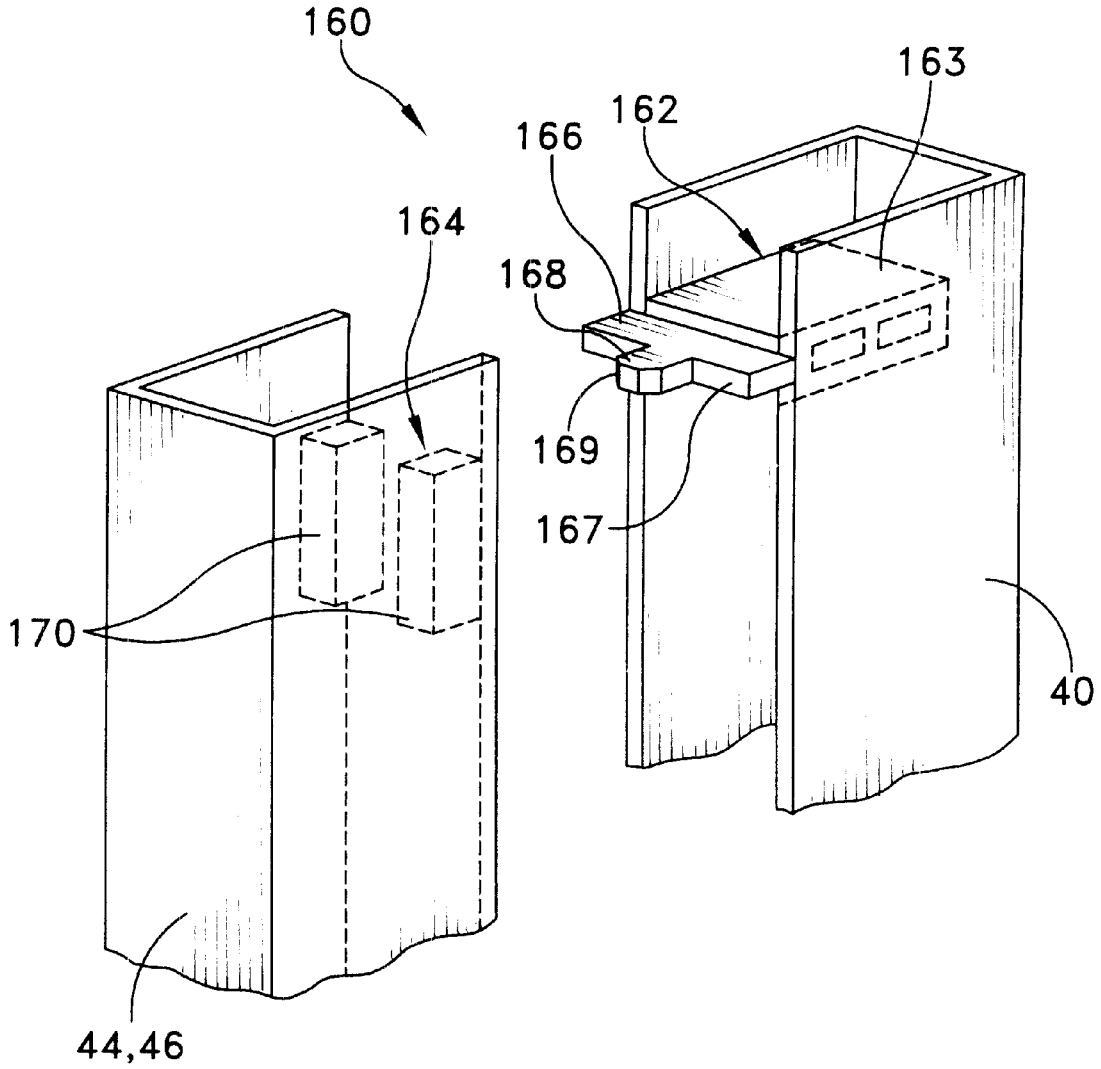
FIG. 13 is a partial perspective view showing the complementary engaging structures provided at each of four corners of the lift, for positioning and in part for supporting the vertical standards relative to the fixed posts.

FIG. 13 shows a frame stabilizer assembly 160 for maintaining proper alignment between the fixed and movable frames when the lift is in a retracted position and movable standards 44 abut the fixed vertical posts 40. Preferably, four stabilizers 160 are provided, one at the top and bottom of each vertical standard. Each stabilizer 160 includes a male assembly 162 being mounted to a fixed vertical post 40, and a corresponding female assembly 164 which is mounted to a movable standard 44, 46. The male and female sense of these parts can be reversed.

The male assembly 162 includes a bracket 163 that is secured to a fixed vertical post 40. A flange 166 is mounted to bracket 163 and includes a projection 168 that engages the spaced-apart parts 70 of female assembly 164 when the lift is in a stowed position. The projection 168 includes chamfered edges 169 to facilitate the engagement of projection 168 with assembly 164. The flange 166 can be adjusted in or out with respect to bracket 164 to control the distance between the vertical posts 40 and movable standards 44 when the lift is in a fully retracted and stowed position, thus ensuring proper alignment of the movable vertical standards with the fixed vertical posts 40. This arrangement also provides lateral mechanical support.

This assembly provides for lateral support and defines a retraction stop position for movable vertical standards 44 relative to fixed posts 40. If the flange 168 of a stabilizer assembly 160 provided on the upper end of a vertical post 40 is moved rearward (i.e., toward the inside of the van), for example, the movable frame will tilt rearward. The lateral and inboard/outboard position of these parts is thereby adjusted.

Figure 14:
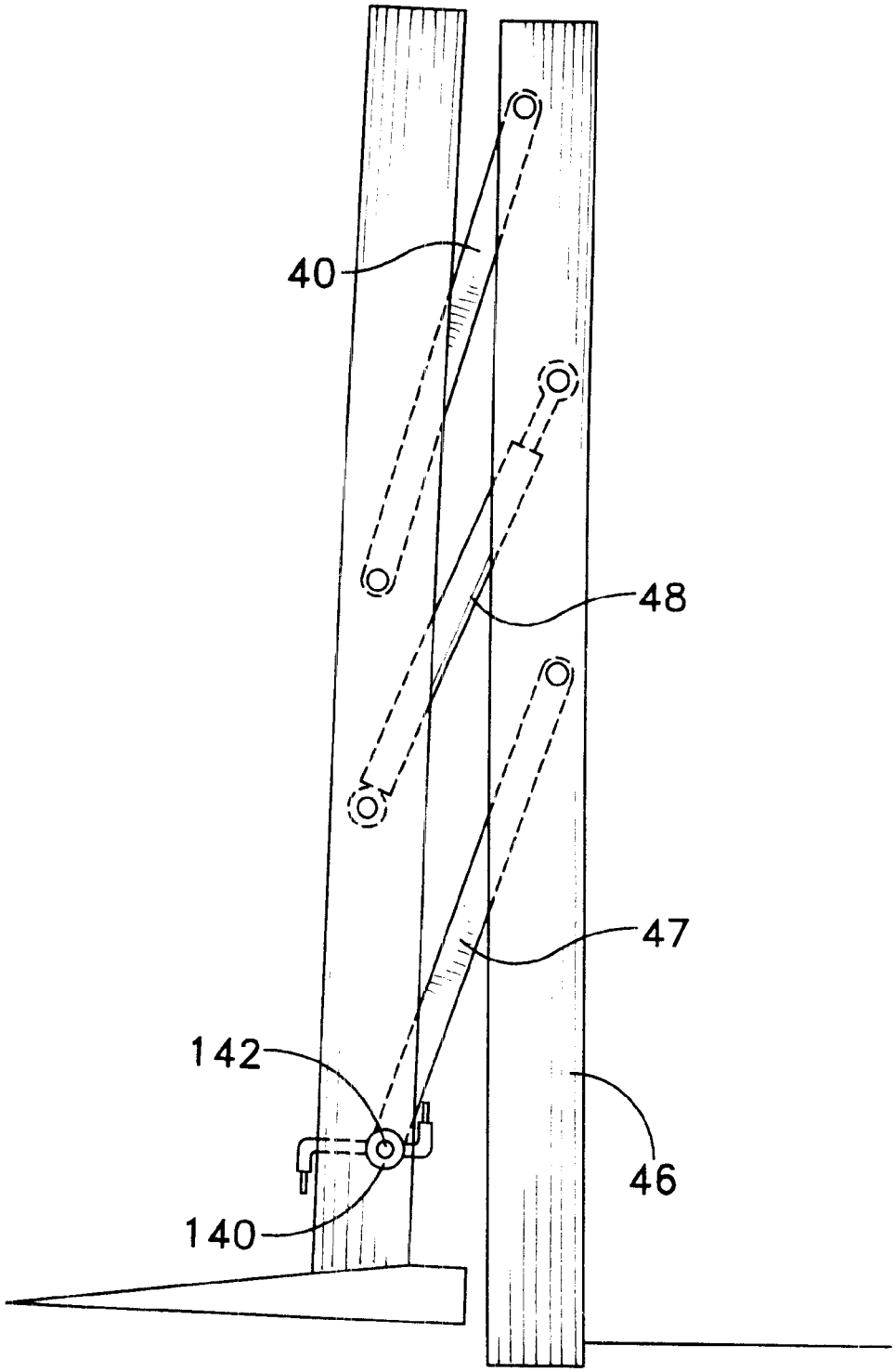
FIG. 14 is a side elevation showing the fixed post, vertically movable standard and parallelogram linkage with coupled drive cylinder.

FIG. 14 generally shows the lift in a retracted position. A frictional or other retarding mechanism such as a variable hydraulic flow valve 140 which adjustably throttles the oil flow rate to the hydraulic cylinders 48 can be provided to limit the speed of platform 32. The valve 140 can comprise a check valve as well as a flowpath that is adjustable in size using a mechanism 142 such as a lever or the like and can be connected to provide a bypass pressure relief that is operable in the direction of lowering of the lift only. In this manner the hydraulic pump raises the lift and gravity lowers the lift subject to the speed restriction embodied by valve 140.

FIG. 15 illustrates certain advantageous arrangements of the drive cylinder(s) 48 versus the parallelogram link members 47, and also a preferred structure wherein the parallelogram members of the lift are caused to compress so as to be stable and compact when retracted. According to one aspect, the upper parallelogram link member 47 can be made just slightly shorter than the lower link member 47, causing the vertical standards 46 to tip rearwardly relative to the fixed vertical posts. In a preferred arrangement, for example, the lower member 47 extends approximately 24 inches whereas the upper member 47 is 23.875 inches (i.e., ⅛ inch shorter). As a result, in the stowed position of the lift, the movable vertical standards pull back against the fixed vertical posts approximately one inch closer at the top than at the bottom. This inward tip of the vertical standards is such that the force of gravity, which of course is vertical, tends to urge the vertical standards toward the fixed posts, compressing the retracted lift and reducing rattling and the like.

The inward tipping as described preferably is enhanced slightly by placing the pivot points of the upper and lower parallelogram link members 47 on a line that tilts inwardly. Thus the lower link member 47 attaches and pivots at a point that is near the outboard side of the vertical posts (and standards) whereas the upper link member 47 is pivoted on the inboard side. These aspects ensure that the lift is compressed and retracted by gravity when the platform is pivoted up and the parallelogram is retracted to the end of its travel.

When the platform is pivoted open, however, the center of gravity of the movable lift elements (the platform and the movable vertical standards) is outboard of the vertical standards. The force of gravity therefore urges the parallelogram linkage members to permit the lift to lower. No power is necessary to commence lowering of the lift.

According to another aspect, unlike many conventional lifts the invention comprises a hydraulic cylinder that is disposed between the upper and lower link members 47 on both the vertical fixed posts and movable standards. As shown in FIG. 15, the cylinder is inclined relative to the link members 47, in an outward direction when the lift is raised or a downward direction when the lift is lowered. The cylinder cannot be precisely parallel to the link members 47 or the cylinder would not expand or contract the parallelogram. By canting the cylinder relative to links 47 in the direction shown, the cylinder can be powered in a retraction to raise the lift. Additionally, the cylinder pulls the movable standards against the fixed posts when the lift is fully retracted.

The specific angle chosen for the hydraulic cylinder in the embodiment shown allows just a small amount of clearance between the cylinder and the link members 47, which are coextensively coupled between the posts 40 and the standards 46. The cylinder 48 is inclined outwardly within the space allotted between the parallelogram links 47 in the refracted position of the lift.

In FIG. 15, the cylinder body is about 16 inches in length and over the span of the lift the cylinder expands from a short limit of about 18 inches to a long limit of about 28 inches, being nominally 26.25 inches at the point at which the platform is lowered to nominal ground level (the load/unload level if the vehicle is on a horizontal surface as opposed to a hill or curb area). In this embodiment the pivots for links 47 are about 23 inches apart on both the posts and the standards. On the inboard side, the cylinder pivots are about 7 inches below the upper link pivot on the post (16 inches above the lower pivot on the post). On the outboard side, namely on the movable vertical standards, the cylinder pivots are 13 inches below the upper pivot and 10 inches above the lower one. In other words, the cylinder pivots are on a line that is about three inches above parallel to the links 47 on the inboard side and three inches below parallel to the links on the outboard side. This takes advantage of the available space between the links in the retracted position, provides reasonably good mechanical advantage and limits the span required of the cylinder.

The lift according to the invention can be varied in a number of ways. For example the lift can be mounted in a left or right doorway frame, to a rear door rather than a side door and behind swinging or sliding door panels. The foregoing discussion of preferred embodiments discloses a particular arrangement of linked movable elements and driving arrangements. However other specific couplings and drive arrangements will also achieve similar functional operation as described.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A platform lift comprising:

a stationary post defining at least a portion of a structural frame for attachment on an inboard side and at one lateral side of a doorway;

a vertical standard, movably mounted on the stationary post by at least two parallelogram link arms, the vertical standard being coupled to a lift platform;

wherein the post, the standard and the parallelogram link arms are pivotally attached together at spaced pivot points on horizontal axes, substantially defining apices of a parallelogram of which the post is disposed at an inboard side and the standard is disposed on an outboard side;

a drive cylinder operable by a power source for forcibly extending or retracting the drive cylinder, and wherein the drive cylinder is coupled between the standard and the post at pivot points that are spaced from the apices of the parallelogram on at least one of the post and the standard; and, wherein an upper one of the parallelogram links is shorter than a lower one of the parallelogram links, such that the standard is tilted in an inboard direction toward the post when the lift is retracted.

2. The platform lift of claim 1, wherein the parallelogram is structured such that movable outboard parts of the lift have a center of gravity that is substantially over a portion of inboard parts of the lift when the lift is retracted.

3. The platform lift of claim 1, further comprising a second said stationary post and a second said vertical standard at an opposite lateral side of the doorway, wherein the platform is pivotable upwardly and downwardly on a horizontal hinge axis relative to the vertical standard, on a baseplate that is hingeable on a vertical axis relative to one of said two vertical standards and said two fixed posts.

4. The platform lift of claim 3, wherein the baseplate of the platform is mounted on a vertical hinge axis to a first said vertical standard and is detachably coupled to the second said vertical standard spaced laterally from the first vertical standard.

5. The platform lift of claim 1, further comprising a powered drive for folding the platform upwardly and downwardly on a horizontal hinge axis relative to the vertical standard, wherein the powered drive has a speed variation such that a rate of such folding is decreased at least at one extreme of a span of the folding, relative to a speed at another point in the span of folding.

6. The platform lift of claim 5, wherein the powered drive is coupled to the platform by a cam for controlling the rate of folding.

7. A platform lift for a doorway, comprising:

at least one stationary post defining at least a portion of a structural frame on an inboard side of the lift, the post being rigidly fixable at a lateral side of the doorway;

a vertical standard, movably mounted on the stationary post by at least two parallelogram link arms, the vertical standard being coupled to a lift platform;

wherein the post, the standard and the parallelogram link arms are pivotally attached together at spaced pivot points on horizontal axes, substantially defining apices of a parallelogram of which the post is disposed at an inboard side and the standard is disposed on an outboard side, with a drive cylinder for forcibly extending and retracting the parallelogram to raise and lower the lift;

a barrier mechanism comprising a barrier member which is linked mechanically between at least two movable elements of the lift; and, a mechanical linkage coupled between the barrier mechanism and at least two relatively movable points, each of the relatively movable points being coupled to one of the post, the standard and the link arms, wherein the barrier mechanism is retracted in a retracted position of the lift and is moved by the mechanical linkage to deploy across the doorway when the lift is deployed, movement of the barrier mechanism being driven mechanically through the linkage by movement of said post, standard and link arms.

8. The platform lift for a doorway according to claim 7, wherein the barrier mechanism has a lost motion range, wherein the barrier member is deployed by the mechanical linkage substantially into a position blocking movement through the doorway, over an initial span of displacement of the lift away from the retracted position of the lift, further comprising a stop for the barrier member when deployed in said position blocking movement through the doorway, and wherein the lost motion range permits further displacement of the lift while the barrier member is deployed in said position blocking movement.

9. The platform lift for a doorway according to claim 7, wherein the barrier mechanism has a lost motion range such the barrier member can encounter an obstruction when being deployed, before reaching a stop, and the lost motion range permits continued displacement of the lift while the barrier member is arrested by the obstruction.

10. The platform lift for a doorway according to claim 7, wherein the barrier member is rotatably coupled to the post so as to remain substantially in a plane of the doorway, while moving to and from said position blocking movement.

11. The platform lift for a doorway according to claim 10, wherein a plurality of said barrier members are coupled to the post and the barrier mechanism includes a linkage between said plurality of barrier members.

* * * * *